US008043016B2

(12) United States Patent
Kogure et al.

(10) Patent No.: US 8,043,016 B2
(45) Date of Patent: Oct. 25, 2011

(54) IMAGE FORMING APPARATUS

(75) Inventors: Seiichi Kogure, Kanagawa (JP); Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1162 days.

(21) Appl. No.: 11/793,584

(22) PCT Filed: Oct. 10, 2006

(86) PCT No.: PCT/JP2006/320523
§ 371 (c)(1),
(2), (4) Date: Jun. 19, 2007

(87) PCT Pub. No.: WO2007/046309
PCT Pub. Date: Apr. 26, 2007

(65) Prior Publication Data

US 2008/0145123 A1 Jun. 19, 2008

(30) Foreign Application Priority Data

Oct. 20, 2005 (JP) ..... 2005-305464
Oct. 27, 2005 (JP) ..... 2005-312213

(51) Int. Cl.
*B41J 2/01* (2006.01)
*B41J 11/42* (2006.01)

(52) U.S. Cl. ..... 400/279; 400/579; 347/1; 347/5; 347/104

(58) Field of Classification Search ..... 400/279, 400/579; 347/1; *B41J 11/42*
See application file for complete search history.

(56) References Cited

U.S. PATENT DOCUMENTS 6,888,650 B1 * 5/2005 Mizubata et al. ..... 358/488
2004/0028450 A1 * 2/2004 Jung ..... 400/709

FOREIGN PATENT DOCUMENTS

| | | | |
|---|---|---|---|
| JP | 2-81869 | | 3/1990 |
| JP | 8-132605 | | 5/1996 |
| JP | 10095150 | A * | 4/1998 |
| JP | 10329987 | A * | 12/1998 |
| JP | 11-115264 | | 4/1999 |
| JP | 11-334161 | | 12/1999 |
| JP | 2000-318875 | | 11/2000 |
| JP | 2003-252482 | | 9/2003 |
| JP | 2003252482 | A * | 9/2003 |
| JP | 2004-161446 | | 6/2004 |
| JP | 2004161446 | A * | 6/2004 |
| JP | 2004-237693 | | 8/2004 |
| JP | 2004237693 | A * | 8/2004 |

OTHER PUBLICATIONS

Machine translation of JP 2003252482 A, JPO, Nov. 5, 2010.*
Machine translation of JP 2004161446 A, JPO, Nov. 5, 2010.*
Machine translation of JP 10095150 A, JPO, Nov. 7, 2010.*
Machine translation of JP 2004237693 A, JPO, Nov. 7, 2010.*

* cited by examiner

*Primary Examiner* — Judy Nguyen
*Assistant Examiner* — Nguyen Q Ha
(74) *Attorney, Agent, or Firm* — Cooper & Dunham LLP

(57) ABSTRACT

An image forming apparatus that forms an image on a recording medium by conveying the recording medium in a direction orthogonal to a scanning direction of a carriage having a recording head includes a first detecting unit mounted on the carriage and configured to detect the recording medium; a second detecting unit placed upstream from the first detecting unit in the direction that the recording medium is conveyed and configured to detect the recording medium; and a control unit configured to control operations of the image forming apparatus based on a detection result from the first detecting unit or the second detecting unit.

18 Claims, 20 Drawing Sheets

FIG.12

| PAPER TYPE | DISTANCE BETWEEN PAPER SHEETS |
|---|---|
| PLAIN PAPER | 40mm |
| GLOSS PAPER | 60mm |
| OHP | 60mm |

IMAGE FORMING APPARATUS

TECHNICAL FIELD

The present invention generally relates to an image forming apparatus, and more particularly relates to an image forming apparatus having one or more recording heads mounted on the carriage.

BACKGROUND ART

A serial-type image forming apparatus is a type of image forming apparatus such as a printer, a facsimile, a copier, a plotter, or a multifunction copier having functions of a printer, facsimile, and copier. A serial-type image forming apparatus normally includes one or more recording heads (print heads) mounted on a carriage which recording heads are made of liquid drop spraying heads that spray drops of recording liquids (for example, inks). In such a serial-type image forming apparatus, the carriage is moved to serially scan a recording medium (hereafter called a paper sheet, but not limited to a sheet of paper, and may also be called recording paper, a transfer medium, a printing medium, or the like) in a direction orthogonal to the direction in which the recording medium is conveyed; and the recording medium is conveyed intermittently a recording width at a time. An image is formed (recorded or printed) on the recording medium by repeating conveying and recording steps alternately.

In such an image forming apparatus, if the edges of a paper sheet are detected incorrectly, liquid drops may be sprayed onto an area outside of the paper sheet. This may deteriorate the image quality or smear a conveying unit such as a conveyor belt. Patent document 1 discloses an image forming apparatus that has a paper sheet sensor mounted on a carriage for scanning a paper sheet widthwise and is thereby able to accurately detect the edges of the paper sheet on a plane close to the image forming area.

[Patent document 1] Japanese Patent Application Publication No. 2004-237693

In an image forming apparatus having recording heads for spraying liquid drops, the nozzles of the recording heads and a paper sheet sensor for detecting the leading edge of a paper sheet must be aligned appropriately. However, because of irregularities in assembling, the distance between the recording head nozzles and the paper sheet sensor may vary. This makes it necessary to align the recording head nozzles and the paper sheet sensor (this process is called "registration adjustment").

On the other hand, the demand is high for an increased printing speed of image forming apparatuses. When printing multiple pages, the printing speed can be increased by narrowing the distance between a preceding paper sheet and a succeeding paper sheet (hereafter called a distance between paper sheets). However, in a configuration where a sensor for detecting the leading edge of a paper sheet is mounted on a carriage, there is a time gap between when the scanning of a preceding paper sheet is finished and when the detection of the leading edge of a succeeding paper sheet is started, because the carriage has to be moved to a specified position so that the sensor is able to detect the leading edge of the succeeding paper sheet. This time gap makes it difficult to reduce the distance between paper sheets below a certain level. In other words, improvement in techniques for detecting the leading edge of a paper sheet has a great effect in improving the printing speed of an image forming apparatus.

One way to solve the above mentioned problem is to provide a second paper sheet sensor placed upstream from a first paper sheet sensor on the carriage in the paper conveying direction and thereby to detect the leading edge of a paper sheet using the first and second paper sheet sensors.

However, providing multiple paper sheet sensors for detecting the leading edge of a paper sheet makes it necessary to perform registration adjustment for each of the paper sheet sensors and therefore complicates the process of registration adjustment.

BRIEF SUMMARY

In an aspect of this disclosure, there is provided an image forming apparatus that accurately detects the leading edge of a paper sheet even when the distance between paper sheets is small, thereby making it possible to achieve a faster printing speed.

In another aspect, there is provided an image forming apparatus that makes registration adjustment involving multiple paper sheet sensors simpler.

According to an exemplary embodiment, an image forming apparatus that forms an image on a recording medium by conveying the recording medium in a direction orthogonal to a scanning direction of a carriage having a recording head includes a first detecting unit mounted on the carriage and configured to detect the recording medium; a second detecting unit placed upstream from the first detecting unit in the direction that the recording medium is conveyed, and configured to detect the recording medium; and a control unit configured to control operations of the image forming apparatus based on a detection result from the first detecting unit or the second detecting unit.

BRIEF DESCRIPTION OF THE DRAWINGS

FIG. 12 is a table showing exemplary settings of distances between paper sheets according to the second embodiment;

BEST MODE FOR CARRYING OUT THE INVENTION

Figure 1:
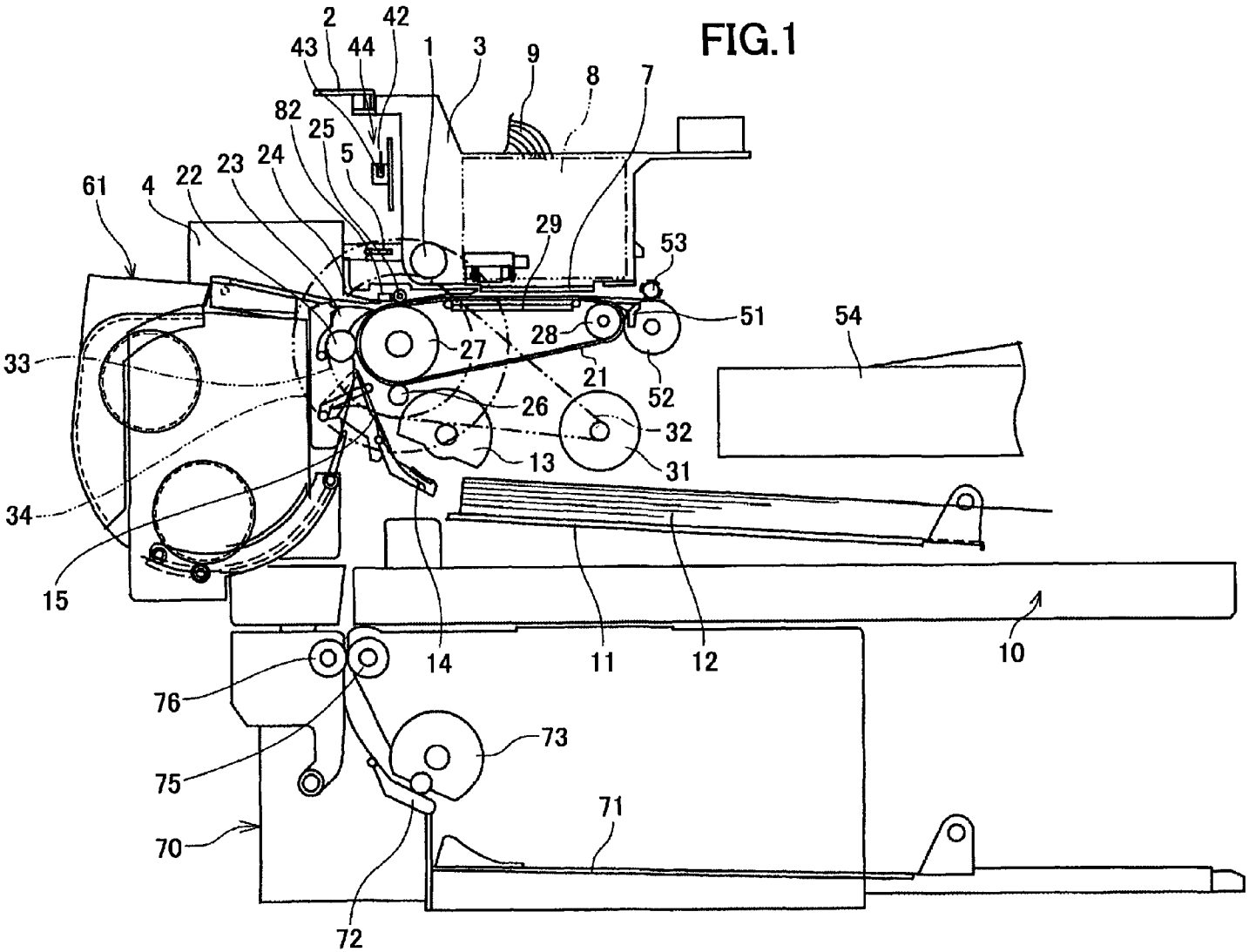
FIG. 1 is a side elevational view of mechanical parts of an exemplary image forming apparatus according to an embodiment of the present invention.
Figure 2:
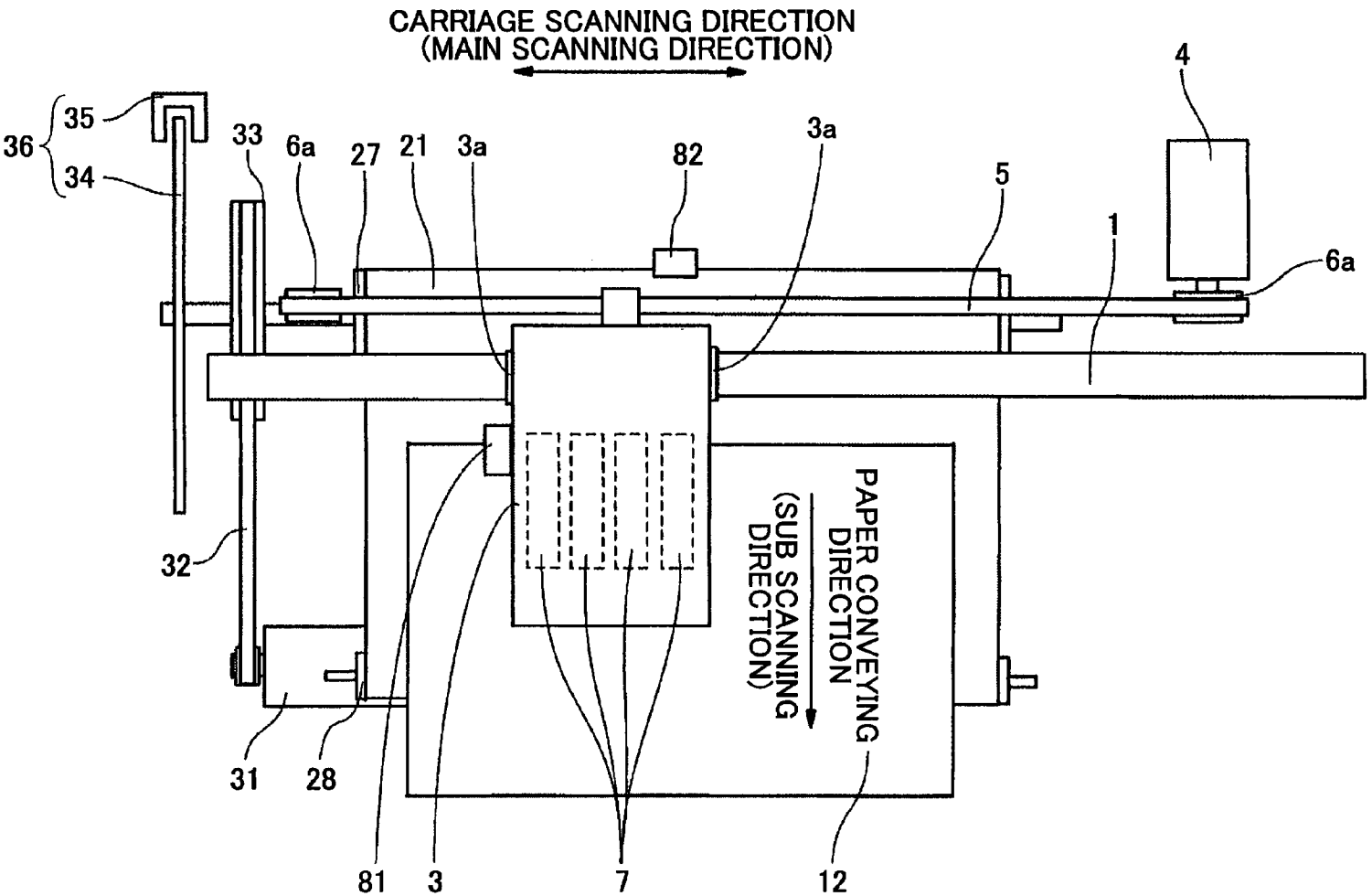
FIG. 2 is a plan view of the mechanical parts shown in FIG. 1.

Preferred embodiments of the present invention are described below with reference to the accompanying drawings. An exemplary image forming apparatus according to an embodiment of the present invention is described below with reference to FIG. 1 and FIG. 2. FIG. 1 is a side elevational view of mechanical parts of an exemplary image forming apparatus according to an embodiment of the present invention. FIG. 2 is a plan view of the mechanical parts shown in FIG. 1.

In the exemplary image forming apparatus, a carriage 3 is supported by a guiding unit, which includes a guide rod 1 and a guide rail 2 laid between right and left sideboards (not shown), so as to be able to slide in the directions of the arrows (main-scanning directions). The carriage 3 is moved in the main-scanning directions by a main-scanning motor 4 via a timing belt 5 stretched between a drive pulley 6*a* and a driven pulley 6*b* shown in FIG. 2. Guide bushes (bearings) 3*a* are provided between the carriage 3 and the guide rode 1.

On the carriage 3, four recording heads 7 composed of liquid drop spraying heads for spraying ink drops of yellow (Y), cyan (C), magenta (M), and black (Bk) are mounted. The recording heads 7 are arranged so that an array of ink spray nozzles forms a right angle with the main scanning directions and ink drops are sprayed downward.

Each of the liquid drop spraying heads forming the recording heads 7 includes an energy-generating unit for generating energy to spray liquid drops. For such an energy-generating unit, a piezoelectric actuator such as a piezoelectric element, a thermal actuator using liquid film boiling caused by an electrothermal converting element such as a heat element, a shape memory alloy actuator using metal phase changes caused by temperature changes, or an electrostatic actuator using static electricity may be used. The recording heads 7 may be composed of one or more liquid drop spraying heads each having arrays of nozzles for spraying different colors.

The carriage 3 also includes sub-tanks 8 for supplying color inks to the recording heads 7. The sub-tanks 8 are supplied with color inks from main-tanks (ink cartridges) (not shown) through ink supply tubes 9. In addition to the recording heads 7 for spraying ink drops, a recording head for spraying drops of fixing liquid (fixing ink), which reacts with recording liquids (inks) and thereby fixes the recording liquids onto the paper sheet, may be provided on the carriage 3.

The exemplary image forming apparatus also includes a paper feeding unit for feeding paper sheets 12 stacked on a paper stacking plate (pressing plate) 11 of a paper feed tray 10. The paper feeding unit includes a crescent roller (paper feed roller) 13, for separating the paper sheets 12 and feeding them one by one from the paper stacking plate 11, and a separating pad 14 facing the crescent roller 13 and made of a material with a high friction coefficient. The separating pad 14 is biased toward the crescent roller 13.

The exemplary image forming apparatus also includes a conveying unit for conveying the paper sheet 12 fed from the paper feeding unit to a position under the recording heads 7. The conveying unit includes a guide 15 that guides the paper sheet 12 fed from the paper feeding unit, a conveyor belt 21 that electrostatically attracts and thereby conveys the paper sheet 12, a counter roller 22 that presses the paper sheet 12 against the conveyor belt 21 and thereby conveys the paper sheet 12, a conveying guide 23 that changes the direction of the paper sheet 12, which is being fed approximately vertically upward, approximately 90 degrees so that the paper sheet 12 is laid on the conveyor belt 21, a pressing part 24, and a paper-edge pressing roller 25 biased by the pressing part 24 toward the conveyor belt 21. The exemplary image forming apparatus further includes a charging roller 26 for charging the surface of the conveying belt 21.

The conveying belt 21 is an endless belt (which may be molded as an endless belt or made by connecting the ends of a belt) stretched between a conveying roller 27 used as a drive roller and a tension roller 28 used as a driven roller. The conveying belt 21 is turned in the paper conveying direction (sub scanning direction) shown in FIG. 2 by the conveying roller 27 rotated by a sub scanning motor 31 via a timing belt 32 and a timing roller 33. A guide 29 is provided under the conveying belt 21 in a position corresponding to the image forming area of the recording heads 7.

Figure 3:
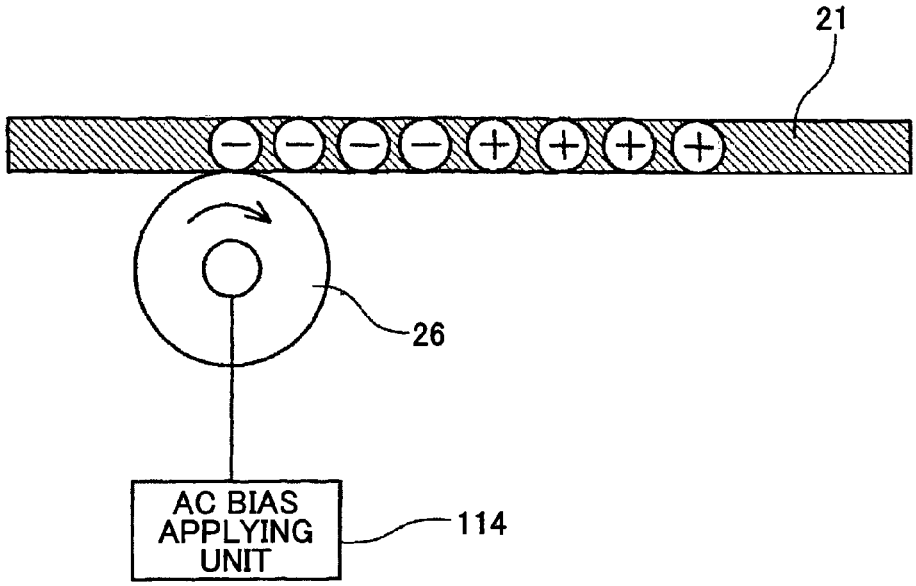
FIG. 3 is a schematic diagram illustrating an exemplary conveyor belt of the exemplary image forming apparatus.
Figure 4:
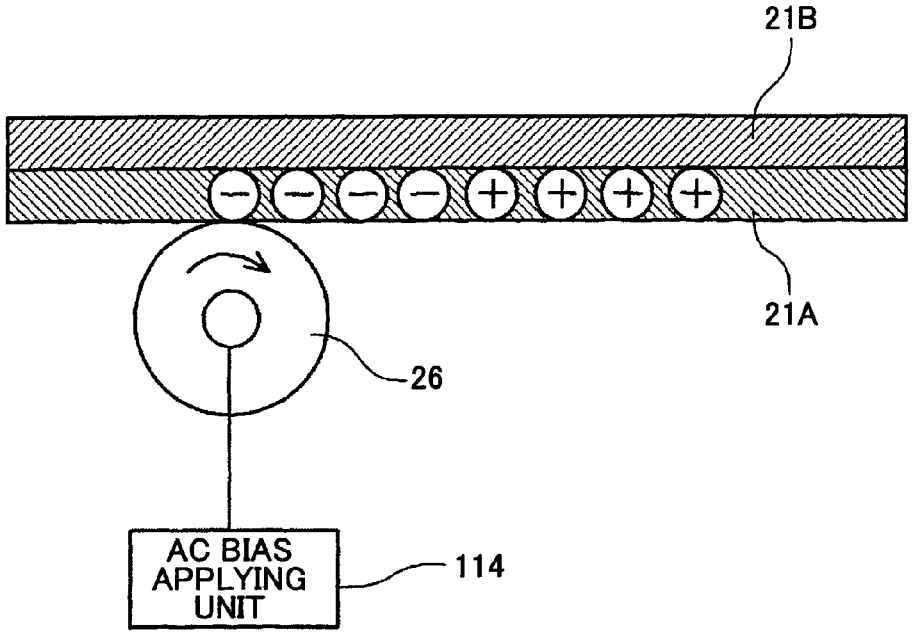
FIG. 4 is a schematic diagram illustrating another exemplary conveyor belt of the exemplary image forming apparatus.

The conveying belt 21 may have a single-layer structure as shown in FIG. 3 or a multi-layer structure (two or more layers) as shown in FIG. 4. The conveyor belt 21 contacts the paper sheet 12 and the charging roller 26. Therefore, when the conveyor belt 21 has only one layer, an insulating material is used to make the layer. When the conveyor belt 21 has multiple layers, for example, two layers, the side contacting the paper sheet 12 and the charging roller 26 is preferably made of an insulating layer 21A and the other side is preferably made of a conductive layer 21B.

The insulating material of the single-layer conveyor belt 21 and the insulating layer 21A of the multi-layer conveyor belt 21 is preferably a resin such as PET, PEI, PVDF, PC, ETFE, or PTFE, or an elastomer containing no conductivity control material. Also, the volume resistivity of the insulating material is preferably $10^{12}$ Ωcm or greater, or more preferably $10^{15}$ Ωcm. The material for the conductive layer 21B of the multi-layer conveyor belt 21 is preferably made by mixing one of the above mentioned resins or an elastomer with carbon so that the volume resistivity of the material becomes $10^5$ through $10^7$ Ωcm.

The charging roller 26 is positioned so as to contact the insulating layer 21A of the conveyor belt 21 (when it has a two-layer structure) and rotate according to the rotation of the conveying belt 21. Force is applied on the both ends of the axle of the charging roller 26. The charging roller 26 is made of a conductive material with a volume resistivity of $10^6$ through $10^9$ Ωcm. An AC bias applying unit 114 (see FIGS. 3 and 4) applies positive and negative AC biases of, for example, 2 kV to the charging roller 26 as described later. The waveform of the AC bias may be a sine wave or a triangular wave, but is preferably a square wave.

As shown in FIG. 2, the exemplary image forming apparatus also includes a rotary encoder 36. The rotary encoder 36 includes an encoder wheel 34 attached to the axle of the conveying roller 27 and an encoder sensor 35 made of a transmission photo sensor for detecting the slits on the encoder wheel 34.

In front of the carriage 3, a linear encoder 44 for detecting the position of the carriage 3 in the main scanning direction is provided. As shown in FIG. 1, the linear encoder 44 includes an encoder scale 42 on which slits are formed and an encoder sensor 43 made of a transmission photo sensor for detecting the slits on the encoder scale 42.

On the carriage 3, a first paper sheet sensor 81 made of a reflection photo sensor is mounted. The first paper sheet sensor 81 is used as a first detecting unit for detecting the leading edge of the paper sheet 12 being conveyed. A second paper sheet sensor 82 is positioned upstream from the paper-edge pressing roller 25 in the paper conveying direction so as to face the conveying roller 27. The second paper sheet sensor 82 is made of a reflection photo sensor and used as a second detecting unit for detecting the leading edge of the paper sheet 12. The first and second paper sheet sensors 81 and 82 are not limited to reflection sensors, but transmission sensors or physical switches may be used for the first and second paper sheet sensors 81 and 82.

In the exemplary image forming apparatus, the second paper sheet sensor 82 is positioned upstream from the paper-edge pressing roller 25 in the paper conveying direction so as not to block the movement of the carriage 3. However, the position of the second paper sheet sensor 82 is not limited to the position shown in FIG. 1. The position of the second paper sheet sensor 82 is preferably as close as possible to the first paper sheet sensor 81 to improve the detection accuracy. Also, the second paper sheet sensor 82 is preferably positioned opposite to the conveying roller 27 so as to be able to detect the paper sheet 12 when it is being conveyed steadily. The paper sheet 12 may be conveyed without using a conveyor belt (for example, by using a conveying roller).

The exemplary image forming apparatus further includes a paper ejecting unit for ejecting the paper sheet 12 on which an image has been recorded by the recording heads 7. The paper ejecting unit includes a sheet separating claw 51 for separating the paper sheet 12 from the conveyor belt 21, a paper ejecting roller 52, a paper ejecting roller 53, and a paper catch tray 54 for receiving the ejected paper sheet 12.

A duplex unit 61 is detachably attached to the back of the exemplary image forming apparatus. The duplex unit 61 takes in the paper sheet 12 that is conveyed backward by the conveyor belt 21 turning in the opposite direction, reverses the paper sheet 12, and feeds the sheet again into the space between the counter roller 22 and the conveyor belt 21.

An extra tray 70 may be attached to the bottom of the exemplary image forming apparatus. The extra tray 70 has a similar configuration to that of the paper feed tray 10 and includes a paper stacking plate (pressing plate) 71, a separating pad 72, a paper feed roller 73, and conveying rollers 75 and 76. The paper feed roller 73 and the separating pad 74 separate the paper sheets 12 and feed them one by one. Then, the conveying rollers 75 and 76 convey the paper sheet 12 upward into the space between the counter roller 22 and the conveyor belt 21.

Figure 5:
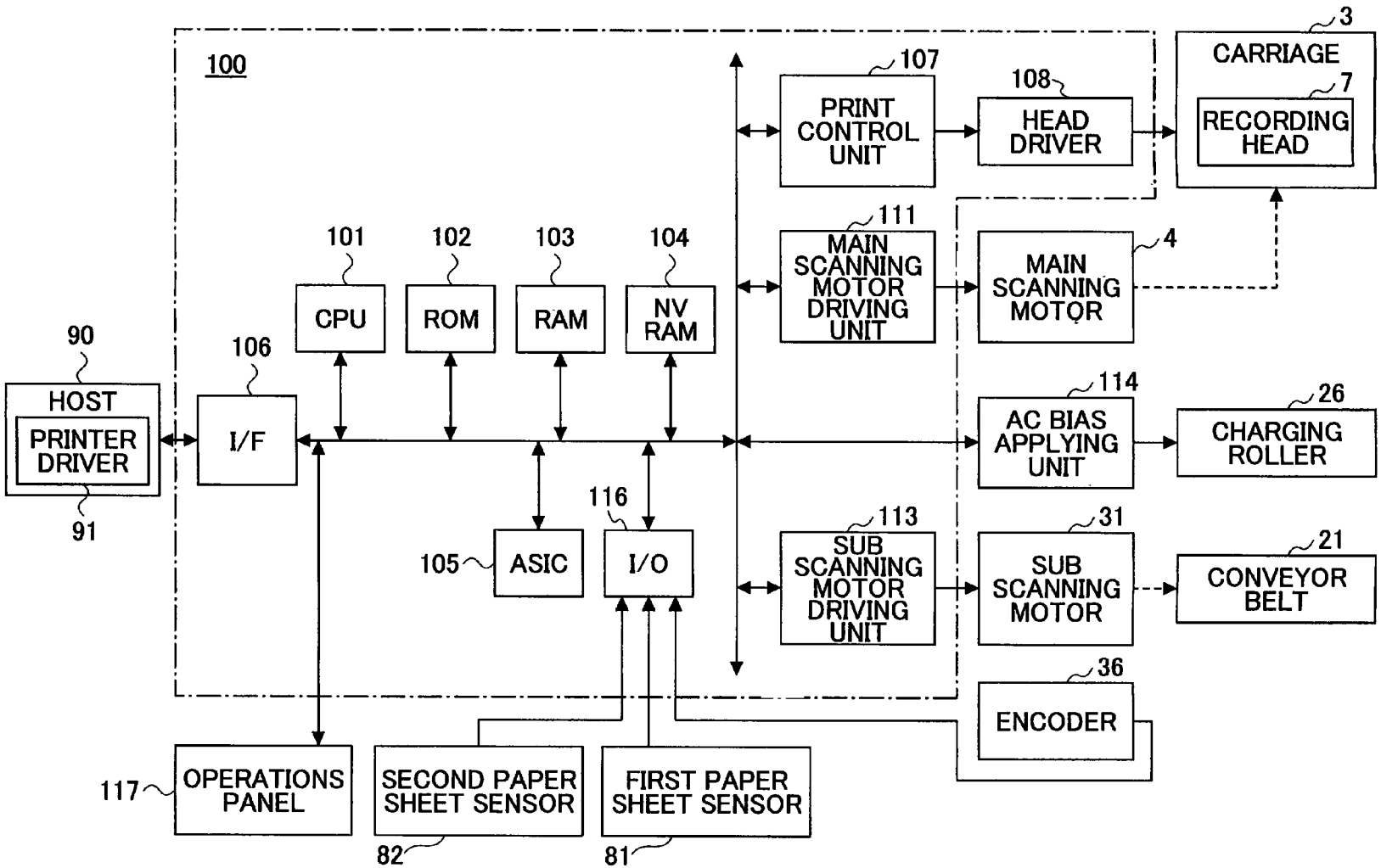
FIG. 5 is a block diagram illustrating an exemplary control unit of the exemplary image forming apparatus.

A control unit of the exemplary image forming apparatus is outlined below with reference to the block diagram shown in FIG. 5.

The control unit 100 includes a CPU 101 for controlling the entire image forming apparatus, a ROM 102 for storing programs to be executed by the CPU 101 and other fixed data, a RAM 103 for temporarily storing image data, a rewritable non-volatile memory 104 that retains data even when the power is off, and an ASIC 105 that performs, for example, signal processing and a sort operation on image data and handles input/output signals for controlling the entire image forming apparatus.

The control unit 100 also includes an I/F 106 for sending/receiving data and signals to/from a host 90, a data processing apparatus such as a personal computer, a print control unit 107 and a head driver 108 for controlling the recording heads 7, a main scanning motor driving unit 111 for driving the main scanning motor 4, a sub scanning motor driving unit 113 for driving the sub scanning motor 31, and an I/O 116 for receiving detection signals from the first paper sheet sensor 81, the second paper sheet sensor 82, the linear encoder 44, and the rotary encoder 36.

An operations panel 117 for inputting and displaying information is connected to the control unit 100. The control unit 100 also turns on and off the AC bias applying unit (high-voltage power supply) 114 for applying an AC bias to the charging roller 26.

The I/F 106 of the control unit 100 receives print data including image data via a cable or a network from the host 90. The host 90 may be a data processing apparatus such as a personal computer, an image reading apparatus such as an image scanner, an imaging apparatus such as a digital camera, or the like. A printer driver 91 of the host 90 generates print data and outputs the generated print data to the control unit 100.

The CPU 101 reads out and analyzes the print data in a receive buffer of the I/F 106, causes the ASIC 105 to perform operations including a sort operation on the print data, and transfers the image data to the print control unit 107. In this embodiment, image data in the print data are converted into bitmap data by the printer driver 91 of the host 90 before the print data are sent to the exemplary image forming apparatus. However, font data may be provided, for example, in the ROM 102 so that the conversion is performed by the exemplary image forming apparatus.

When receiving a portion of the image data (dot pattern data) which portion corresponding to one line of printing by the recording heads 7, the print control unit 107 sends the one line of dot pattern data as serial data to the head driver 108 in synchronization with a clock signal and also sends a latch signal at a specified timing to the head driver 108.

The print control unit 107 includes a drive waveform generating circuit. The drive waveform generating circuit includes a ROM (the ROM 102 may be used for this purpose) containing pattern data of drive waveforms (drive signals); a waveform generating circuit including a D/A converter for converting the drive waveform data read from the ROM from digital to analog; and an amplifier.

The head driver 108 includes a shift register for holding the clock signal and the serial data (image data) from the print control unit 107, a latch circuit for latching a register value of the shift register according to a latch signal from the print control unit 107, a level conversion circuit (level shifter) for changing the level of a value output from the latch circuit, and an analog switch array (switching unit) that is turned on and off by the level shifter. The head driver 108 selectively applies parts of drive waveforms to the actuators of the recording heads 7 by turning on and off the analog switch array and thereby drives the recording heads 7.

The main scanning motor driving unit 111 calculates a control value based on a target value supplied from the CPU 101 and a speed detection value obtained by sampling detection pulses from the encoder 44, and, based on the calculated control value, drives the main scanning motor 4 through an internal motor driver.

Similarly, the sub scanning motor driving unit 113 calculates a control value based on a target value supplied from the CPU 101 and a speed detection value obtained by sampling detection pulses from the encoder 36, and, based on the calculated control value, drives the sub scanning motor 31 through an internal motor driver.

Figure 6:
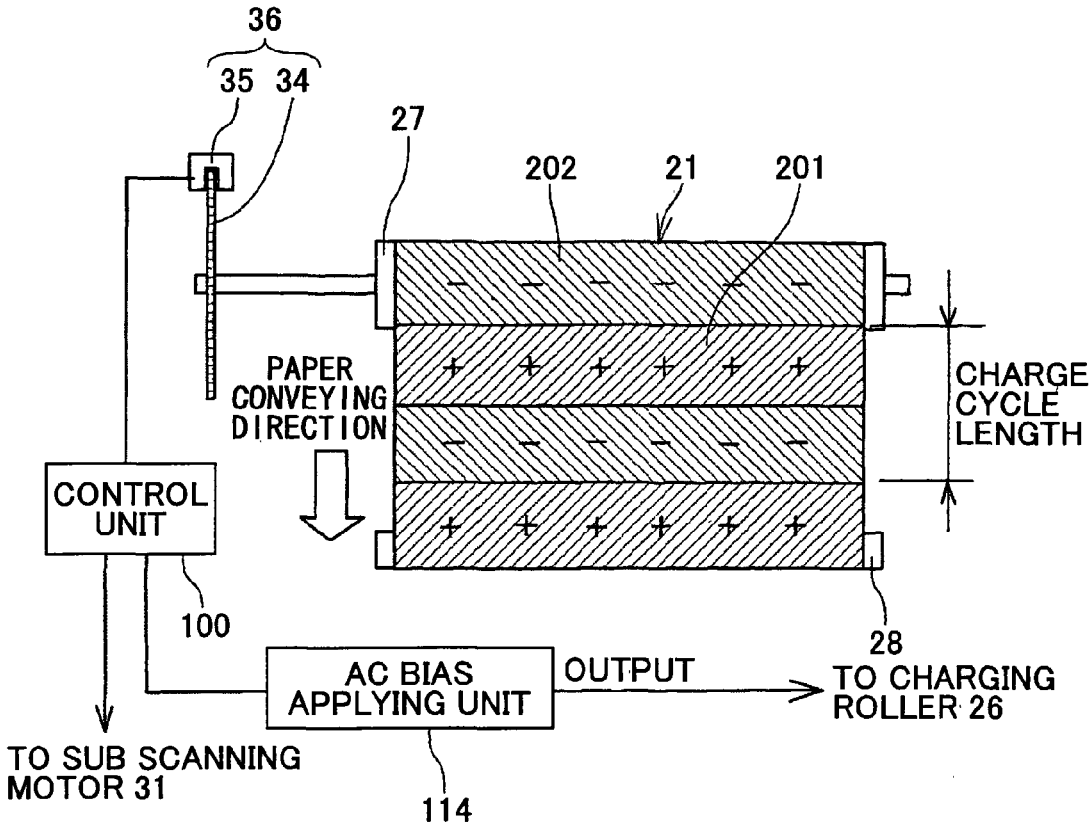
FIG. 6 is a drawing used to describe exemplary charge control in an exemplary printing process of the exemplary image forming apparatus.
Figure 7:
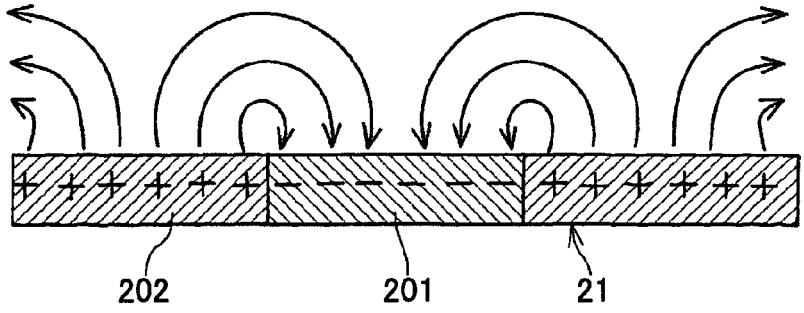
FIG. 7 is a drawing used to describe the state of a charged conveyor belt of the exemplary image forming apparatus.
Figure 8:
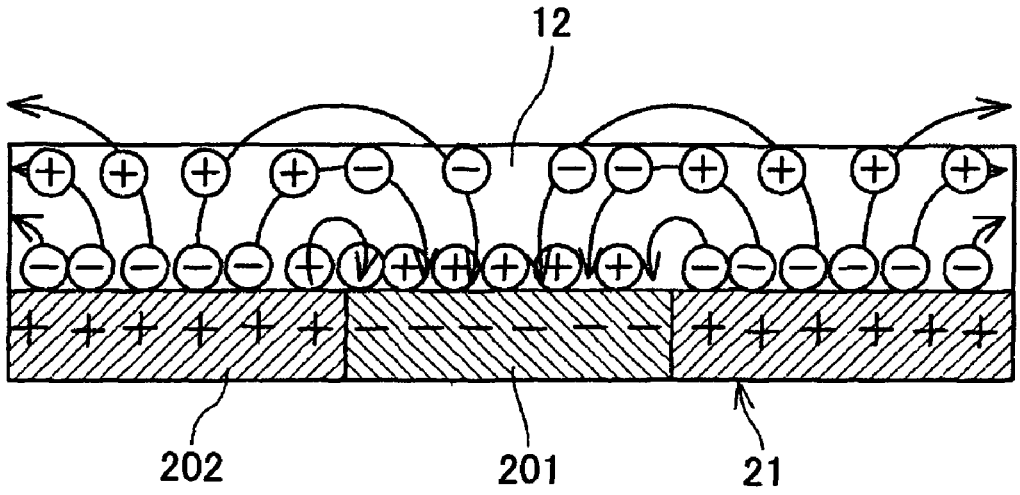
FIG. 8 is a drawing used to describe the state of a paper sheet brought into contact with the charged conveyor belt.

A printing process in the exemplary image forming apparatus is described below with reference to FIGS. 6 through 8.

First, exemplary charge control on the conveyor belt 21 is described below with reference to FIG. 6. As described earlier, the amount of rotation is determined by the encoder 36 attached to one end of the conveying roller 27 for turning the conveyor belt 21. The sub scanning motor driving unit 113 of the control unit 100 controls the sub scanning motor 31 according to the determined amount of rotation and the CPU 101 controls the output of the AC bias applying unit (high-voltage power supply) 114 for applying a high voltage (AC bias) to the charging roller 26.

The AC bias applying unit 114 controls the cycle (the amount of time) of the positive and negative voltages applied to the charging roller 26 and, at the same time, the control unit 100 controls the movement of the conveyor belt 21, thereby making it possible to apply positive and negative voltages with a specific charge cycle length to the conveyor belt 21. As shown in FIG. 6, a "charge cycle length" indicates the width (distance) of one cycle of positive and negative voltages in the paper conveying direction.

When printing is started, the sub scanning motor 31 rotates the conveying roller 27 and thereby turns the conveyor belt 21 clockwise in FIG. 1 and, at the same time, the AC bias applying unit 114 applies positive and negative square waves to the charging roller 26. Since the charging roller 26 is positioned so as to contact the insulating layer 21A of the conveyor belt 21, positive charges and negative charges are alternately applied to the insulating layer 21A of the conveyor belt 21 (a strip-shaped positively-charged area 201 and a strip-shaped negatively-charged area 202 are alternately formed) as shown in FIG. 6. As a result, non-uniform electric fields are formed on the conveyor belt 21 as shown in FIG. 7.

As described earlier, the insulating layer 21A of the conveyor belt 21 is made of a material with a volume resistivity of 1E12 Ωcm or greater, or preferably of 1E15 Ωcm. Such a material prevents the positive and negative charges from moving across their boundary, thereby making it possible to retain the positive and negative charges on the insulating layer 21A.

The paper feed roller 13 and the separating pad 14 separate and feed the paper sheets 12 onto the insulating layer 21A of the conveyor belt 21 where non-uniform electric fields are formed by positive and negative charges. When one of the paper sheets 12 is placed on the non-uniform electric fields on the conveyor belt 21, it is instantly polarized along the directions of the electric fields. Because of the non-uniform electric fields, charges on one side of the paper sheet 12 which side faces the conveyor belt 21 become dense and attract the paper sheet 12 to the conveyor belt 21; and charges on the other side of the paper sheet 12 which charges repel the conveyor belt 21 become sparse. Because of the charge density difference, the paper sheet 12 is instantly attracted to the conveyor belt 21. Also, since the paper sheet 12 has a finite resistance, true charges are induced on both sides of the paper sheet 12.

Positive and negative true charges induced on the side facing the conveyor belt 21 and charges on the conveyor belt 21 attract each other and are therefore stable. Positive and negative true charges induced on the other side are unstable. Since the paper sheet 12 has a finite resistance of 1E7 Ωcm through 1E13 Ωcm, the true charges induced on the other side of the paper sheet 12 are able to move. Therefore, adjacent positive and negative true charges are attracted to each other and neutralized. As a result, the number of the true charges decreases as time passes. The charges on the conveyor belt 21 are balanced by the true charges induced on one side of the paper sheet 12 which side faces the conveyor belt 21, and as a result, their electric fields are terminated. The true charges induced on the other side of the paper sheet 12 are neutralized as described above and their electric fields are terminated. Therefore, the electric fields decrease as the conveyor belt 21 and the paper sheet 12 move closer to the recording heads 7. Also, since the charges on the other side of the paper sheet 12 which charges repel the conveyor belt 21 decrease as time passes, the force attracting the paper sheet 12 to the conveyor belt 21 increases as time passes.

The leading edge of the paper sheet 12 attracted to the conveyor belt 21 as described above is detected by the second paper sheet sensor 82. The control unit 100 stores the timing (the number of pulses) at which the second paper sheet sensor 82 has detected the leading edge of the paper sheet 12, or the distance obtained from the number of pulses and the paper conveying speed in a certain area in the RAM 103.

The paper sheet 12 is then conveyed to a position under the recording heads 7 mounted on the carriage 3 while being pressed onto the conveyor belt 21 by the paper-edge pressing roller 25. Then, the leading edge of the paper sheet 12 is detected again by the first paper sheet sensor 81 mounted on the carriage 3 that has been moved to a specified position for detecting the leading edge. The control unit 100 stores the number of pulses at a time point at which the first paper sheet sensor 81 has detected the leading edge of the paper sheet 12 or the distance obtained from the number of pulses and the conveying speed in a certain area in the RAM 103.

The CPU 101 reads out and analyzes print data in a receive buffer of the I/F 106, causes the ASIC 105 to perform operations including a sort operation on the print data, and transfers the print data to the print control unit 107. When the paper sheet 12 is conveyed to a print start position (first scan position) of the image data transferred to the print control unit 107, there is a pause in the conveyance of the paper sheet 12. The carriage 3 is moved back and forth once (one round trip, the carriage 3 may be moved to make two or more round trips or may be moved only one way) in the main scanning directions and ink drops are sprayed from the recording heads 7 onto the paper sheet 12 to print a portion of the image data transferred from the print control unit 107.

After the portion of the image data is printed, the paper sheet 12 is conveyed to the next printing position by the conveyor belt 21 and the next portion of the image data is printed by moving the carriage 3 back and forth again. When the printing is completed, the paper sheet 12 is further conveyed, separated from the conveyor belt 21 by the separating claw 51, and ejected to the paper catch tray 54. One page of image data is printed as described above.

In the exemplary image forming apparatus, when print data span multiple pages or when multiple pages are printed consecutively, whether printing the next page is necessary is determined while printing a preceding (current) page. When it is determined that printing the next page is necessary, the printing process of the next page is started while the preceding page is being printed. In other words, the paper feed roller 13 starts feeding the next paper sheet 12 so that the distance (gap) between the preceding paper sheet and the succeeding paper sheet becomes a specified value. Then, the next page is printed in the same manner as described above.

An exemplary printing process according to a first embodiment of the present invention is described below with reference to FIGS. 9A, 9B, and 10.

First, an exemplary process of consecutively printing multiple pages is described with reference to FIGS. 9A and 9B. FIGS. 9A and 9B illustrate a process of printing multiple pages where the leading edge of a succeeding paper sheet is detected after the printing on a preceding paper sheet is completed.

Figure 9A:
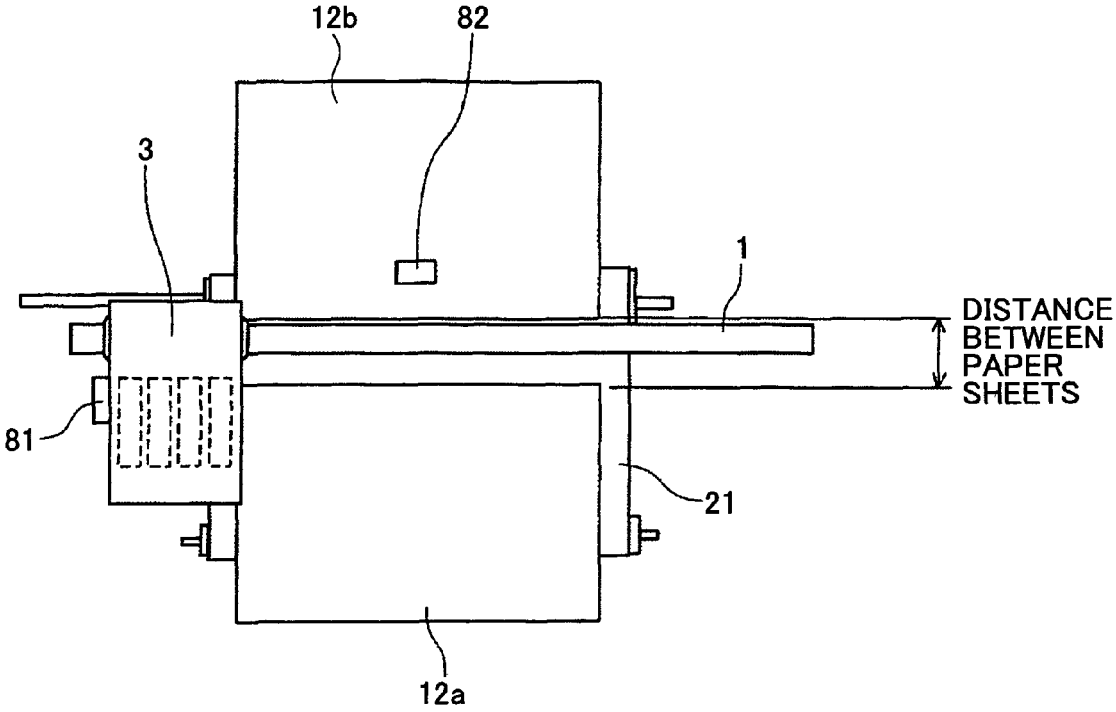
FIGS. 9A and 9B are drawings used to describe an exemplary process of detecting the leading edge of a paper sheet according to a first embodiment of the present invention.

As shown in FIG. 9A, when the scanning of a preceding paper sheet 12*a* is finished, a succeeding paper sheet 12*b* is conveyed with a certain distance from the preceding paper sheet 12 as described above.

Figure 9B:
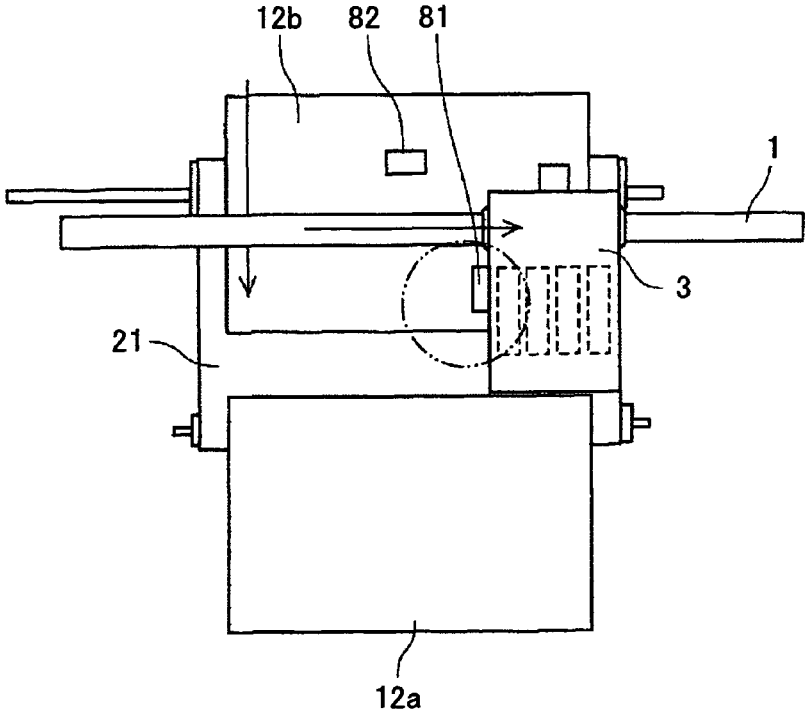

As shown in FIG. 9B, the carriage 3 moves in the direction shown by the arrow to a paper edge detection position (a predetermined position where the leading edge of the paper sheet 12 is detected) to detect the leading edge of the succeeding paper sheet 12*b*. To improve the productivity (or printing speed), the succeeding paper sheet 12*b* is conveyed by the conveyor belt 21 even while the carriage 3 is moving toward the paper edge detection position. One possible problem such a mechanism might cause is that, if the leading edge of the succeeding paper sheet 12*b* passes under the carriage 3 before the carriage 3 reaches the paper edge detection position, the first paper sheet sensor 81 on the carriage 3 is unable to detect the leading edge of the succeeding paper sheet 12*b*.

In the exemplary image forming apparatus, the paper edge detection position of the first paper sheet sensor 81 is set at a position about 5 mm from the left edge (facing the paper conveying direction) of a smallest paper sheet usable. According to an exemplary scanning speed of the carriage 3, when the paper conveying speed is 240 mm/sec or slower and the distance between the paper sheets is 60 mm, the carriage 3 can reach the paper edge detection position of the first paper sheet sensor 81 before the leading edge of the succeeding paper sheet 12*b* reaches the paper edge detection position.

Figure 10:
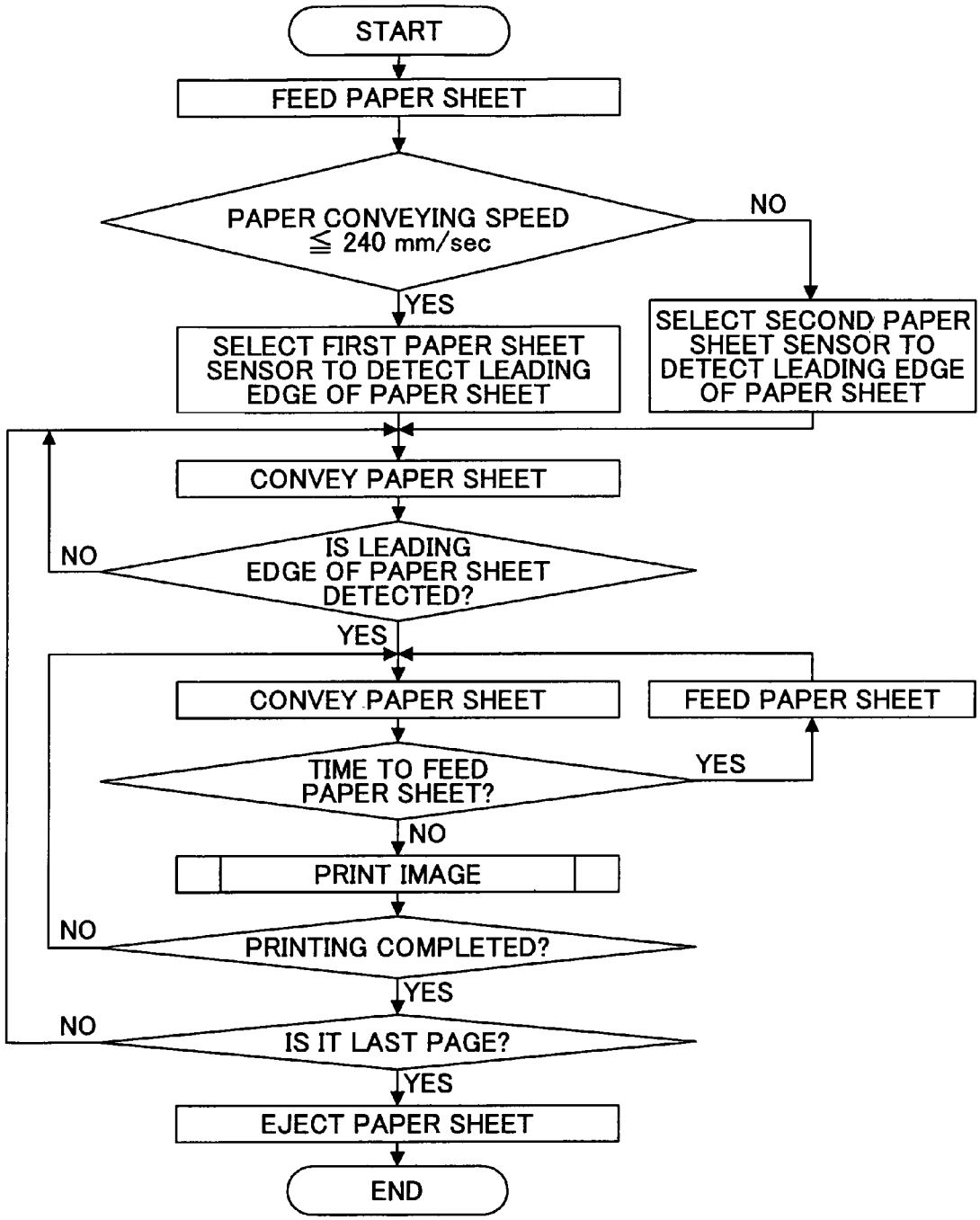
FIG. 10 is a flowchart showing an exemplary printing process according to the first embodiment.

In an exemplary printing process shown in FIG. 10, after feeding the paper sheet 12, the control unit 100 determines whether the paper conveying speed is 240 mm/sec or slower. When the paper conveying speed is 240 mm/sec or slower, the control unit 100 selects the first paper sheet sensor 81 on the carriage 3 to detect the leading edge of the paper sheet 12. When the paper conveying speed is faster than 240 mm/sec, the control unit 100 selects the second paper sheet sensor 82 positioned upstream from the first paper sheet sensor 81 in the paper conveying direction to detect the leading edge of the paper sheet 12.

The control unit 100 causes the conveyor belt 21 to convey the paper sheet 12, detects the leading edge of the paper sheet 12 using the selected paper sheet sensor, the first paper sheet sensor 81 or the second paper sheet sensor 82, and conveys the paper sheet 12 further to the print start position (first scan position). After starting the printing, the control unit 100 determines whether it is time to feed the next paper sheet 12. When it is time to feed the next paper sheet 12, the control unit 100 starts feeding the next paper sheet 12. When it is not time to feed the next paper sheet 12, the control unit 100 starts printing image data on the current paper sheet 12 and repeats the feeding and printing cycle until the printing on the current paper sheet 12 is completed.

The control unit 100 checks if it is the last page to determine whether printing of all pages is completed. If not, the control unit 100 repeats the printing steps until the last page is printed. After the last page is printed, the control unit 100 ejects the last page and terminates the printing process.

As described above, in the exemplary image forming apparatus, the control unit 100 selects either the first paper sheet sensor 81 or the second paper sheet sensor 82 according to the paper conveying speed. This mechanism makes it possible to detect the leading edge of a paper sheet by using the second paper sheet sensor 82 when the first paper sheet sensor is not able to reach its paper edge detection position in time because the distance between a preceding paper sheet and a succeeding paper sheet is too small, thereby making it possible to accurately detect the leading edge of a paper sheet, to increase the printing speed, and to perform stable image forming.

An exemplary printing process according to a second embodiment of the present invention is described below with reference to FIGS. 11 and 12.

According to the second embodiment, the control unit 100 selects either the first paper sheet sensor 81 or the second paper sheet sensor 82 to detect the leading edge of the paper sheet 12 according to a print property. In this embodiment, the distance between paper sheets is changed according to a print property (paper type, in this example) as shown in FIG. 12. As shown in FIG. 12, the distance between paper sheets is set to a small value (for example, 40 mm) for plain paper, because a higher printing speed is demanded when printing on plain paper. On the other hand, the distance between gloss paper sheets or OHP sheets is set to a larger value (for example, 60 mm), because a smaller value increases the risk of causing paper feed troubles.

When the paper conveying speed is constant, the time from when the final scanning of a preceding paper sheet is completed until when the leading edge of a succeeding paper sheet passes the paper edge detection position of the first paper sheet sensor 81 becomes shorter as the distance between the paper sheets becomes smaller. Therefore, when the distance between paper sheets is below a certain value, the leading edge of a succeeding paper sheet may pass under the carriage 3 before the carriage 3 reaches the paper edge detection position.

Figure 11:
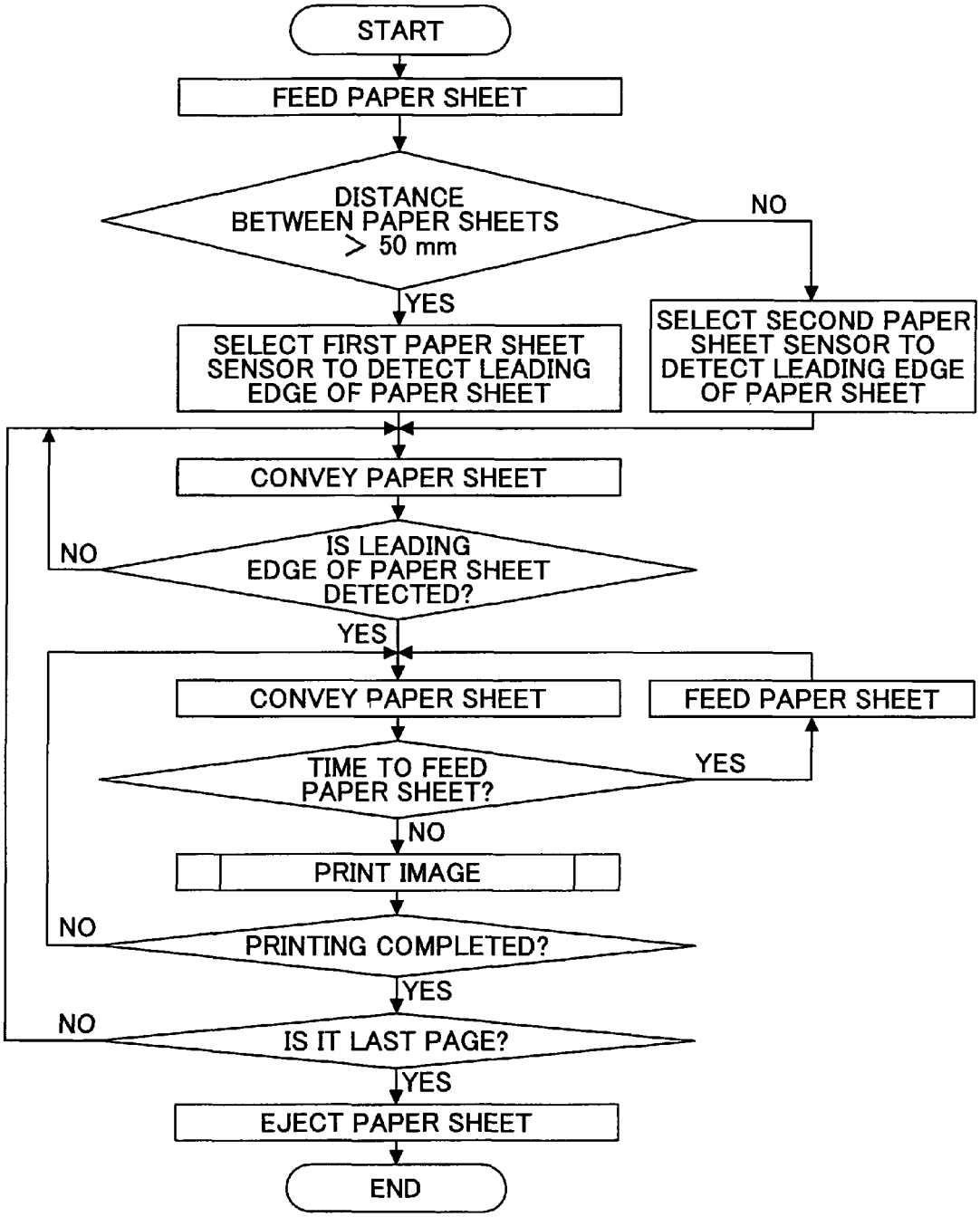
FIG. 11 is a flowchart showing an exemplary printing process according to a second embodiment of the present invention.

In an exemplary printing process shown in FIG. 11, after feeding the paper sheet 12, the control unit 100 checks the print property to determine whether the distance between paper sheets is 50 mm or larger. When the distance between paper sheets is 50 mm or larger, the control unit 100 selects the first paper sheet sensor 81 on the carriage 3 to detect the leading edge of the paper sheet 12. When the distance between paper sheets is smaller than 50 mm, the control unit 100 selects the second paper sheet sensor 82 positioned upstream from the first paper sheet sensor 81 in the paper conveying direction to detect the leading edge of the paper sheet 12.

The control unit 100 causes the conveyor belt 21 to convey the paper sheet 12, detects the leading edge of the paper sheet 12 using the selected paper sheet sensor, the first paper sheet sensor 81 or the second paper sheet sensor 82, and conveys the paper sheet 12 further to the print start position (first scan position). After starting the printing, the control unit 100 determines whether it is time to feed the next paper sheet 12. When it is time to feed the next paper sheet 12, the control unit 100 starts feeding the next paper sheet 12. When it is not time to feed the next paper sheet 12, the control unit 100 continues printing on the current paper sheet 12 and repeats the feeding and printing cycle until the printing on the current paper sheet 12 is completed.

The control unit 100 checks if it is the last page to determine whether printing of all pages is completed. If not, the control unit 100 repeats the printing steps until the last page is printed. After the last page is printed, the control unit 100 ejects the last page and terminates the printing process.

As described above, in the exemplary printing process according to the second embodiment, the control unit 100 selects either the first paper sheet sensor 81 or the second paper sheet sensor 82 according to the distance between paper sheets (or according to the paper type). This mechanism makes it possible to detect the leading edge of a paper sheet by using the second paper sheet sensor 82 when the first paper sheet sensor is not able to reach its paper edge detection position in time because the distance between a preceding paper sheet and a succeeding paper sheet is too small, thereby making it possible to accurately detect the leading edge of a paper sheet, to increase the printing speed, and to perform stable image forming.

Meanwhile, it may be possible that the distance between paper sheets becomes smaller than the value defined for each print property because of a paper feed trouble. To obviate such a problem, the exemplary image forming apparatus may be configured to measure the distance between paper sheets using the second paper sheet sensor 82 or another detecting unit and to select a paper sheet sensor based on the measured distance.

In the second embodiment, the distance between paper sheets is defined for each print property and the first paper sheet sensor 81 or the second paper sheet sensor 82 is selected based on the defined distance to detect the leading edge of a paper sheet. However, the exemplary image forming apparatus may be configured to select the first paper sheet sensor 81 or the second paper sheet sensor 82 to detect the leading edge of a paper sheet based on a condition such as a paper type, a paper thickness, the resistance of paper, single-side/double-side printing, a paper size, and so on.

In the exemplary printing processes according to the above embodiments, a step of selecting the first paper sheet sensor 81 or the second paper sheet sensor 82 is performed even for the first page. However, the exemplary image forming apparatus may be configured to use the first paper sheet sensor 81 for the first page regardless of the paper conveying speed or the distance between the paper sheets.

Figure 13:
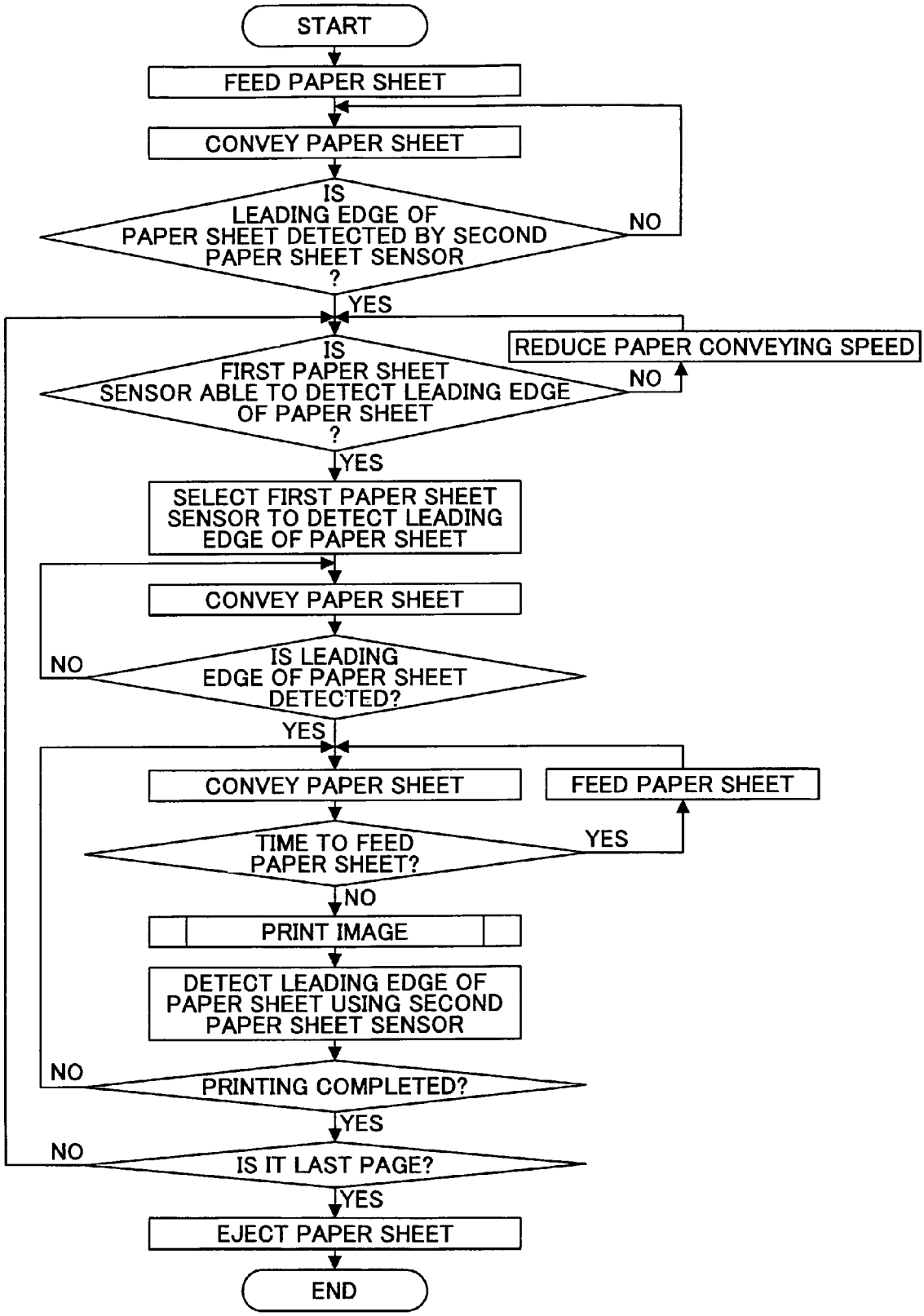
FIG. 13 is a flowchart showing an exemplary printing process according to a third embodiment of the present invention.

An exemplary printing process according to a third embodiment of the present invention is described below with reference to FIGS. 13 through 15.

In the third embodiment, the first paper sheet sensor 81 works in conjunction with the second paper sheet sensor 82. In the exemplary printing process shown in FIG. 13, the control unit 100 causes the paper feed roller 13 to feed the paper sheet 12, causes the conveyor belt 21 to convey the paper sheet 12, and detects the leading edge of the paper sheet 12 using the second paper sheet sensor 82. The control unit 100 stores the timing (the number of pulses) at which the second paper sheet sensor 82 has detected the leading edge of the paper sheet 12 or the distance obtained from the number of pulses and the paper conveying speed in a certain area in the RAM 103.

The CPU 101 in the control unit 100 compares condition data in the ROM 102, the RAM 103, and the non-volatile memory 104 with the paper detection timing data stored in the RAM 103 and thereby determines whether the leading edge of the paper sheet 12 can be detected by the first paper sheet sensor 81 on the carriage 3. The condition data includes the paper conveying speed, image data, scanning speed of the carriage 3, distance between paper sheets, paper type, single-side/double-side printing, and timing of nozzle cleaning.

When it is not possible for the first paper sheet sensor 81 to detect the leading edge of the paper sheet 12 or when the carriage 3 is not able to reach the paper edge detection position in time, the control unit 100 reduces the paper conveying speed so that the carriage 3 can reach the paper edge detection position in time.

After reducing the paper conveying speed so that the first paper sheet sensor 81 can detect the leading edge of the paper sheet 12, the control unit 100 causes the conveyor belt 21 to convey the paper sheet 12, detects the leading edge of the paper sheet 12 using the first paper sheet sensor 81, and conveys the paper sheet 12 further to the print start position (first scan position). After starting the printing, the control unit 100 determines whether it is time to feed the next paper sheet 12. When it is time to feed the next paper sheet 12, the control unit 100 starts feeding the next paper sheet 12 and detects its leading edge using the second paper sheet sensor 82. When it is not time to feed the next paper sheet 12, the control unit 100 starts printing image data on the current paper sheet 12 and repeats the feeding and printing cycle until the printing on the current paper sheet 12 is completed.

The control unit 100 then checks if it is the last page to determine whether printing of all pages is completed. If not, the control unit 100 repeats the printing steps until the last page is printed. After the last page is printed, the control unit 100 ejects the last page and terminates the printing process.

The above process is described below with reference to FIGS. 14A through 15B. FIGS. 14A through 15B are schematic views of the carriage 3 seen from above.

Figure 14A:
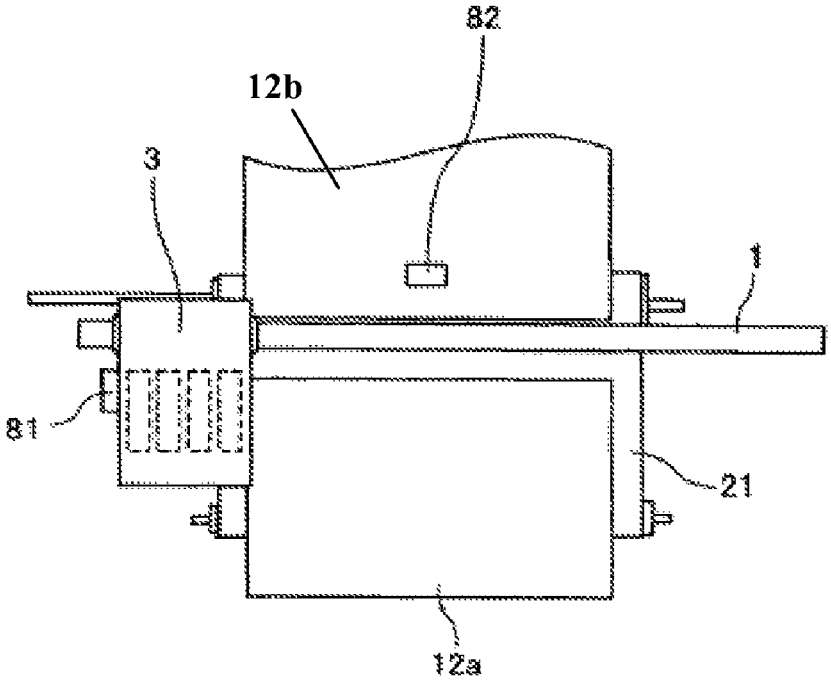
FIGS. 14A and 14B are drawings used to describe the exemplary printing process according to the third embodiment.
Figure 14B:
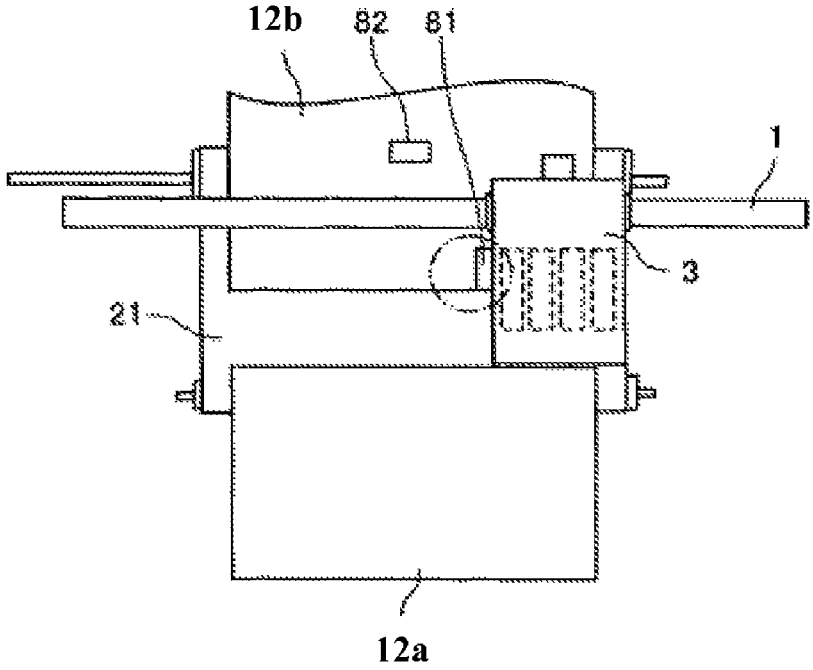
Figure 15A:
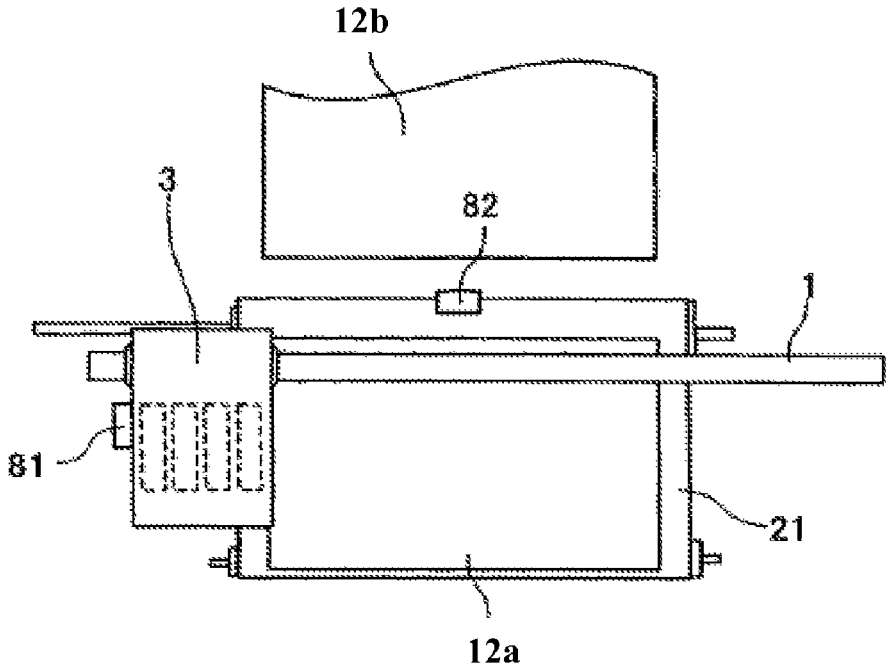
FIGS. 15A and 15B are drawings used to describe the exemplary printing process according to the third embodiment.
Figure 15B:
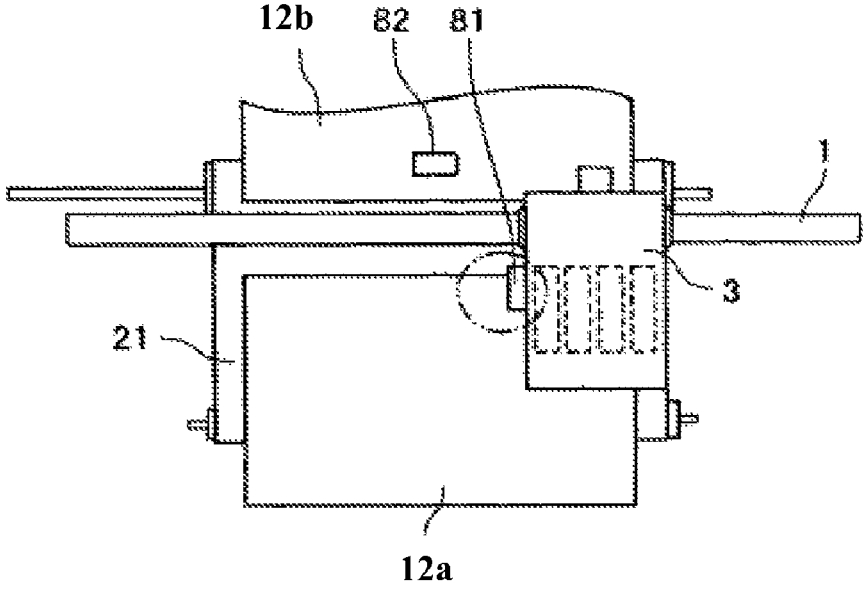

In FIG. 14A, printing on the current paper sheet 12*a* has been completed. In FIG. 15A, printing on the current paper sheet 12*a* finishes with one more scan. In FIGS. 14B and 15B, the carriage 3 has been moved to the paper edge detection position to detect the leading edge of the next paper sheet 12*b* and the next paper sheet 12*b* has been conveyed further.

As shown in FIG. 15B, when the carriage 3 is moved before the printing on the current paper sheet 12*a* is completed, the first paper sheet sensor 81 on the carriage 3 is able to detect the leading edge of the next paper sheet 12*b*. However, as shown in FIG. 14B, when the carriage 3 is moved after the printing on the current paper sheet 12*a* is completed, the first paper sheet sensor 81 is not able to detect the leading edge of the next paper sheet 12*b* because the leading edge of the next paper sheet 12*b* has already passed under the first paper sheet sensor 81. In the third embodiment, when the carriage 3 is moved after the printing on the current paper sheet 12*a* is completed, the paper conveying speed of the next paper sheet 12*b* is reduced so that the carriage 3 can reach the paper edge detection position in time.

Figure 16:
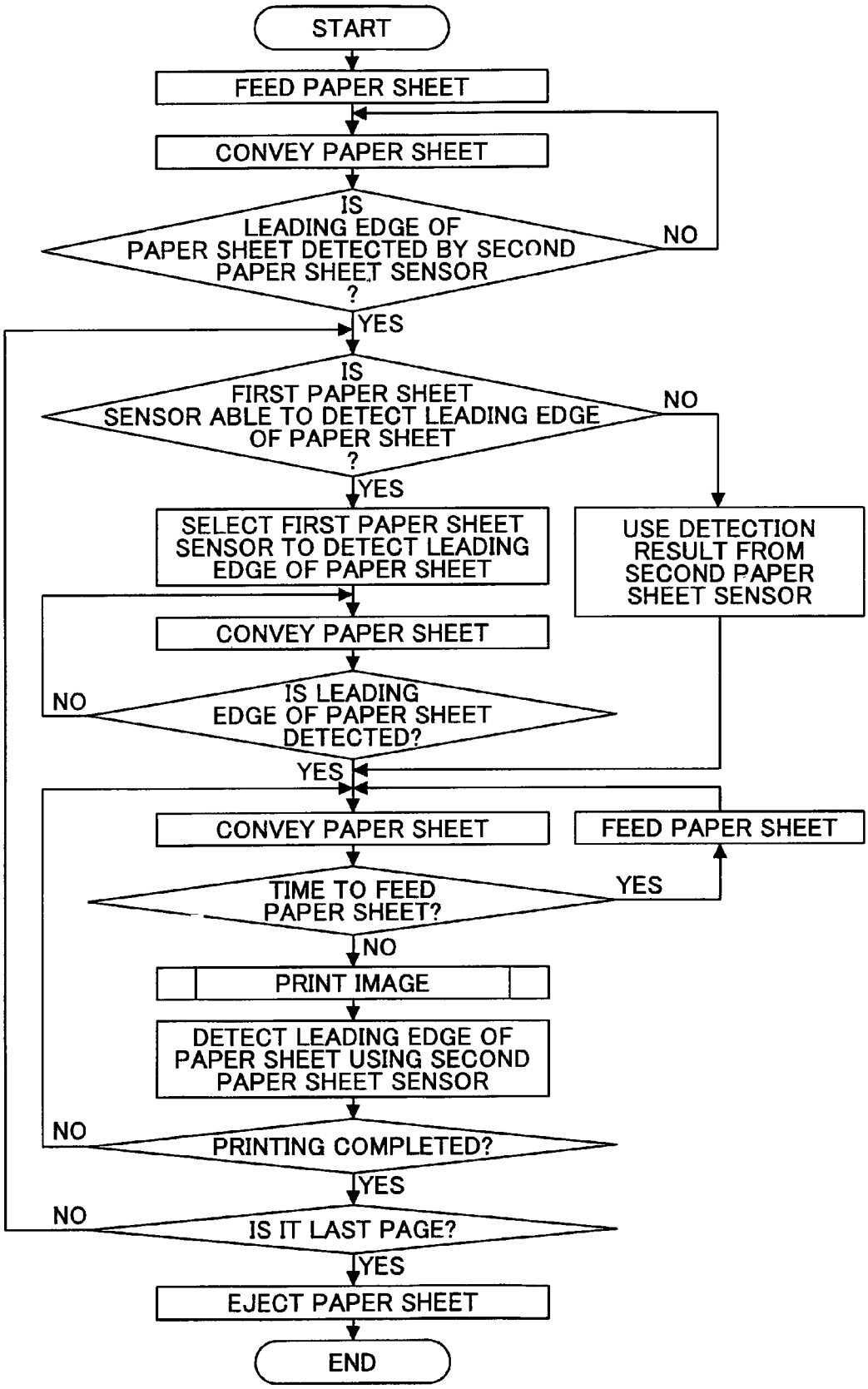
FIG. 16 is a flowchart showing an exemplary printing process according to a fourth embodiment of the present invention.

An exemplary printing process according to a fourth embodiment of the present invention is described below with reference to FIG. 16.

In the fourth embodiment, the first paper sheet sensor 81 works in conjunction with the second paper sheet sensor 82. In the exemplary printing process shown in FIG. 16, the control unit 100 causes the paper feed roller 13 to feed the paper sheet 12, causes the conveyor belt 21 to convey the paper sheet 12, and detects the leading edge of the paper sheet 12 using the second paper sheet sensor 82 in a similar manner to that of the third embodiment. The control unit 100 stores the timing (the number of pulses) at which the second paper sheet sensor 82 has detected the leading edge of the paper sheet 12 or the distance obtained from the number of pulses and the paper conveying speed in a certain area in the RAM 103.

The CPU 101 in the control unit 100 compares condition data in the ROM 102, the RAM 103, and the non-volatile memory 104 with the paper detection timing data stored in the RAM 103 and thereby determines whether the leading edge of the paper sheet 12 can be detected by the first paper sheet sensor 81 on the carriage 3.

When it is possible for the first paper sheet sensor 81 to detect the paper sheet 12, the control unit 100 selects the first paper sheet sensor 81. When it is not possible for the first paper sheet sensor 81 to detect the leading edge of the paper sheet 12, the control unit 100 uses the result of detecting the leading edge of the paper sheet 12 by the second paper sheet sensor 82 to perform the subsequent steps. The subsequent steps are substantially the same as in the third embodiment and the descriptions of the subsequent steps are omitted here.

An exemplary skew correction process in the exemplary image forming apparatus is described below with reference to FIGS. 17 and 18.

As described earlier, the paper edge detection positions of the first paper sheet sensor 81 and the second paper sheet sensor 82 are different in the main scanning direction (width direction of the paper sheet 12). This configuration makes it possible to determine the amount of skew of the paper sheet 12 based on the detection results from the first paper sheet sensor 81 and the second paper sheet sensor 82 and to perform skew correction based on the determined amount of skew by, for example, rotating image data using the ASIC 105 during the image forming process.

Figure 17:
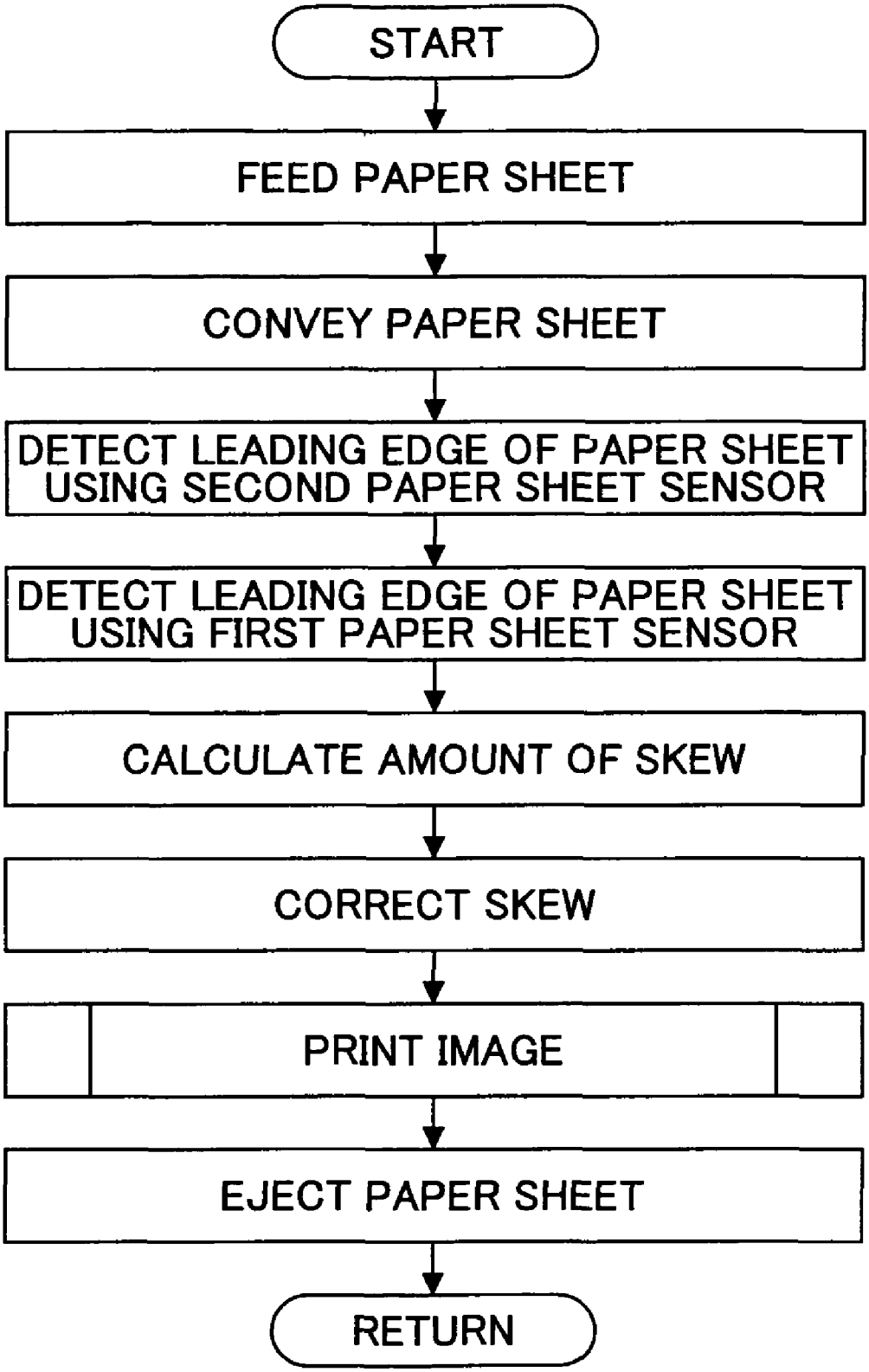
FIG. 17 is a flowchart showing an exemplary skew correction process in the exemplary image forming apparatus.

In the exemplary skew correction process shown in FIG. 17, the control unit 100 causes the paper feed roller 13 to feed the paper sheet 12, causes the conveyor belt 21 to convey the paper sheet 12, detects the leading edge of the paper sheet 12 using the second paper sheet sensor 82, and detects the leading edge of the paper sheet 12 again using the first paper sheet sensor 81. Then, the control unit 100 calculates the amount of skew based on the detection results of the first and second paper sheet sensors 81 and 82, performs skew correction by, for example, rotating the image data based on the calculated amount of skew, prints the image data, and ejects the paper sheet 12.

Figure 18:
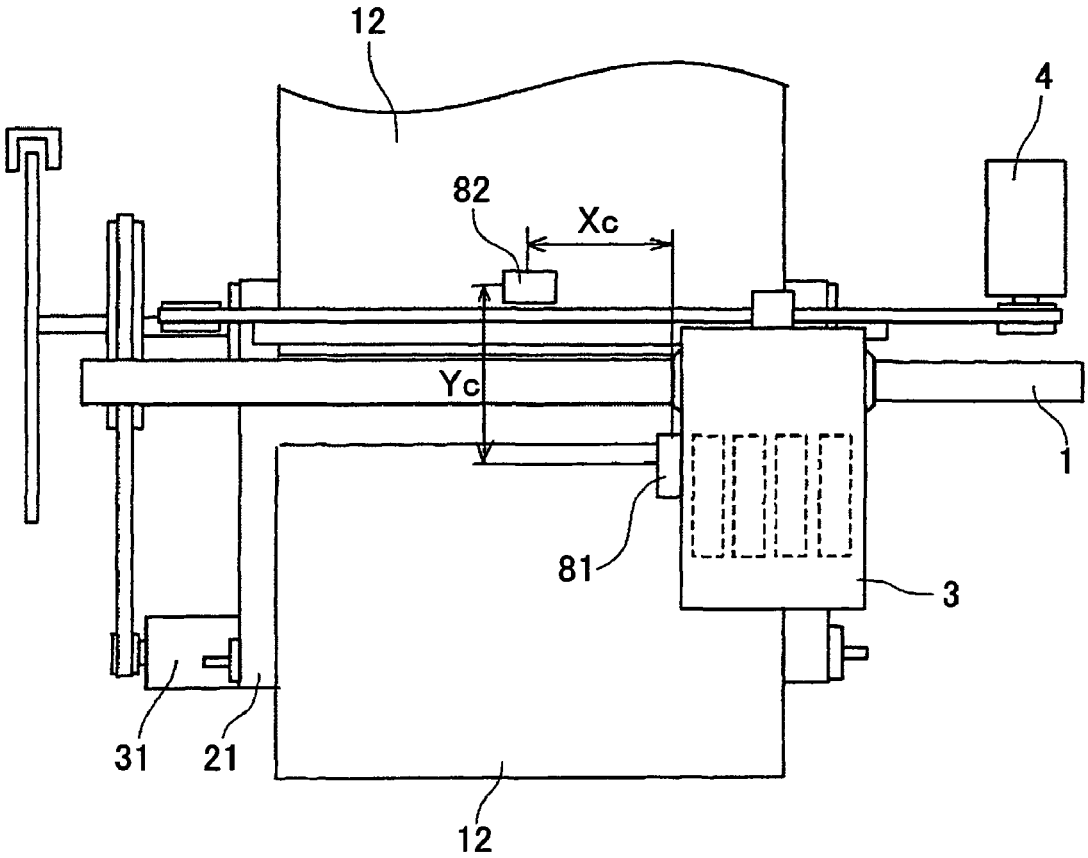
FIG. 18 is a drawing used to describe the exemplary skew correction process shown in FIG. 17.

For example, when the paper edge detection positions of the first paper sheet sensor 81 and the second paper sheet sensor 82 are determined as shown in FIG. 18, the distance (or the number of pulses) Yc in the paper conveying direction between the first paper sheet sensor 81 and the second paper sheet sensor 82 can be determined. When the paper sheet 12 is tilted to the right, the first paper sheet sensor 81 detects the leading edge of the paper sheet 12 at a timing earlier than the normal timing (the timing when the paper sheet 12 is not skewed). When the paper sheet 12 is tilted to the left, the first paper sheet sensor 81 detects the leading edge of the paper sheet 12 at a timing later than the normal timing.

When the distance in the paper conveying direction between the first paper sheet sensor 81 and the second paper sheet sensor 82 is Yc, the amount of skew per unit distance of the paper sheet 12 is expressed by the following equation:

amount of skew=[leading edge position detected by the first paper sheet sensor 81−(leading edge position detected by the second paper sheet sensor 82+Yc)]/Xc As described above, the amount of skew of the paper sheet 12 can be obtained based on the leading edge positions detected by the first paper sheet sensor 81 and the second paper sheet sensor 82.

Although the distances between the two paper sheet sensors and the detected leading edge positions are used to calculate the amount of skew in the above example, substantially the same result may be obtained based on leading edge detection timings (the number of pulses obtained from the encoder).

As the distance between the paper edge detection positions of the first paper sheet sensor 81 and the second paper sheet sensor 82 becomes larger in the width direction, the accuracy of detecting the amount of skew of the paper sheet increases. Therefore, to more accurately determine the amount of skew of a paper sheet, the exemplary image forming apparatus may be configured to change the paper edge detection position in the width direction according to the paper size specified by the printer driver 91 so that the paper edge detection position is set at a position 5 mm from the side edge of a paper sheet.

Further, the exemplary image forming apparatus may be configured to display a warning message (on the display unit of the operations panel 117 or through the printer driver 91 of the host 90) in addition to or instead of performing skew correction such as image rotation when the amount of skew is greater than a specified value; or to eject a paper sheet when the amount of skew of the paper sheet is greater than a specified value and to feed another paper sheet to continue the printing.

An exemplary registration adjustment process in the exemplary image forming apparatus is described below with reference to FIGS. 19 and 21.

Figure 19:
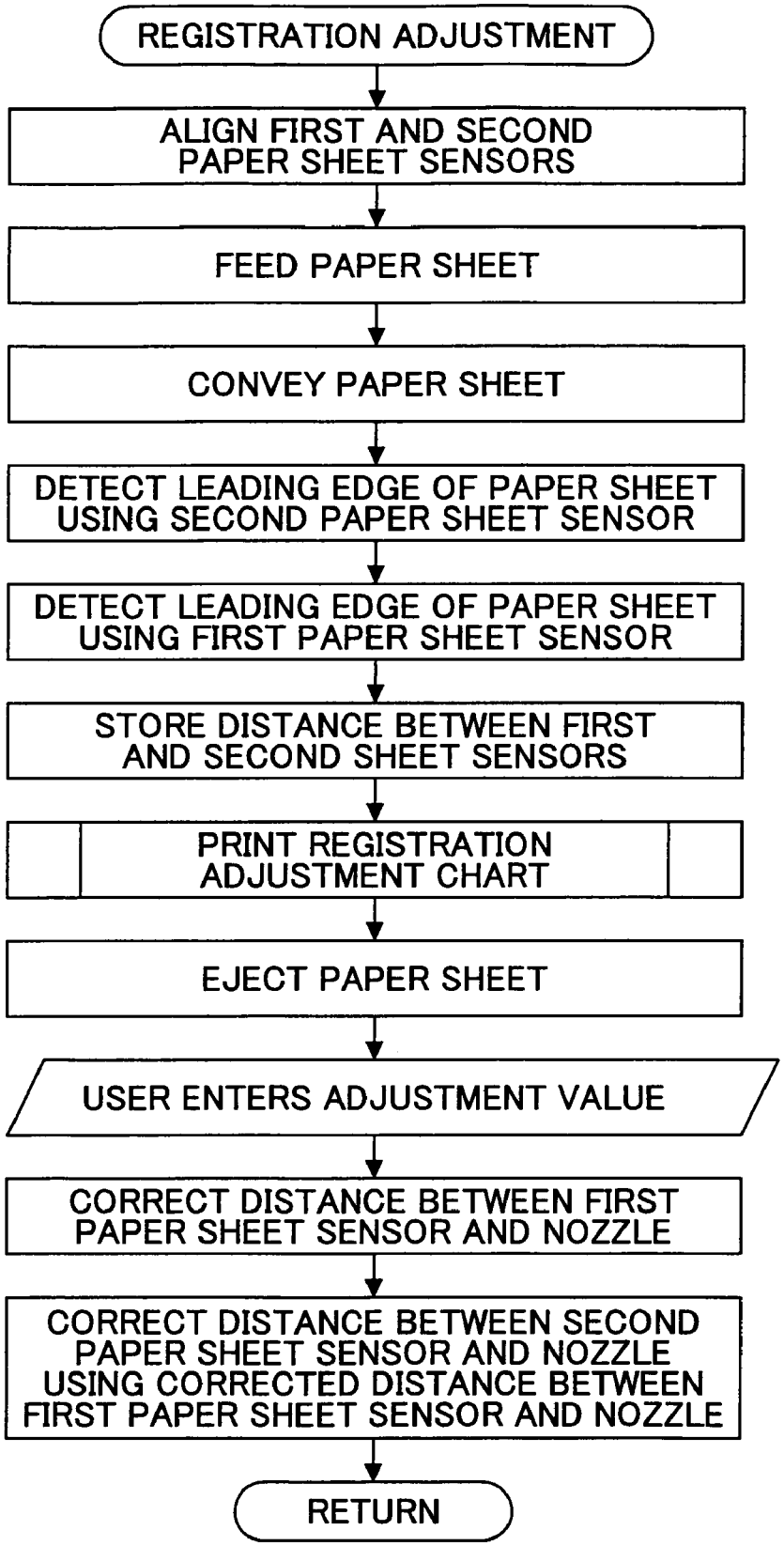
FIG. 19 is a flowchart showing an exemplary registration adjustment process in the exemplary image forming apparatus.
Figure 20:
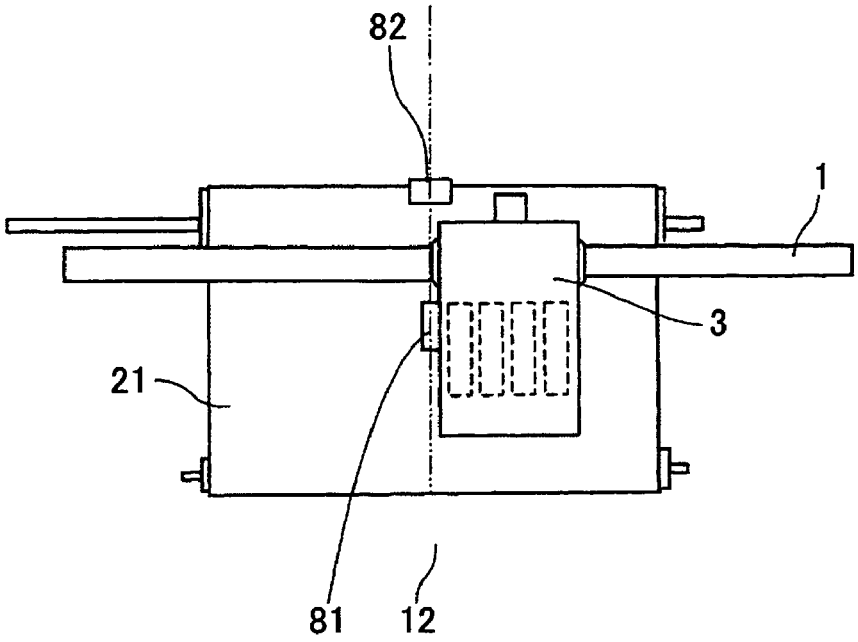
FIG. 20 is a drawing used to describe the exemplary registration adjustment process shown in FIG. 19.

The exemplary registration adjustment process shown in FIG. 19 may be started by a user instruction. First, as shown in FIG. 20, the control unit 100 aligns the first paper sheet sensor 81 with the second paper sheet sensor 82 in a direction perpendicular to the scanning direction of the carriage 3. Aligning the first paper sheet sensor 81 and the second paper sheet sensor 82 makes it possible to ignore the skew of the paper sheet, thereby making it possible to accurately adjust the registration.

The control unit 100 then feeds the paper sheet 12 and causes the conveyor belt 21 to convey the paper sheet 12. The control unit 100 counts the number of pulses sent from the rotary encoder 36 from when the second paper sheet sensor 82 detects the leading edge of the paper sheet 12 until when the first paper sheet sensor 81 detects the leading edge of the paper sheet 12; and stores the number of pulses (or the distance obtained from the number of pulses and the paper conveying speed) in a certain area in the RAM 103 as a distance X between the first paper sheet sensor 81 and the second paper sheet sensor 82 shown in FIG. 21.

Figure 21:
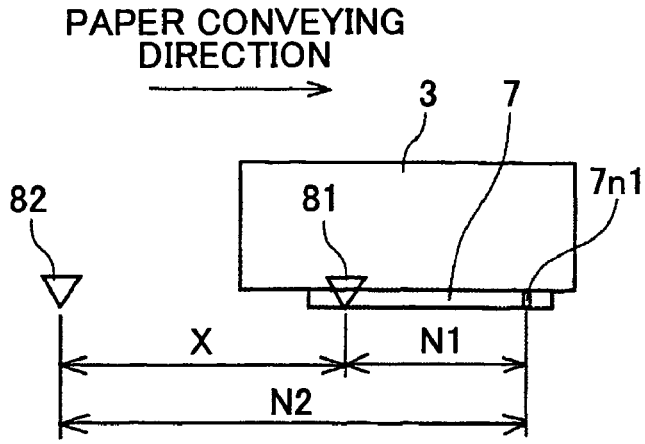
FIG. 21 is a drawing used to describe the exemplary registration adjustment process shown in FIG. 19.

The control unit 100 conveys the paper sheet 12 based on the leading edge detection result from the first paper sheet sensor 81, prints a registration adjustment chart using a first nozzle **7*n*1 (a nozzle in an uppermost position in the direction opposite to the paper conveying direction) of the recording heads 7 shown in FIG. 21, and ejects the paper sheet 12**.

The user checks the printed registration adjustment chart and enters adjustment values from, for example, the operations panel 117. The control unit 100 corrects the distance N1 between the first paper sheet sensor 81 and the first nozzle **7*n*1 using the entered adjustment values. The control unit 100 then corrects the distance N2 between the second paper sheet sensor 82 and the first nozzle 7*n*1 using the corrected distance N1**.

Figure 22:
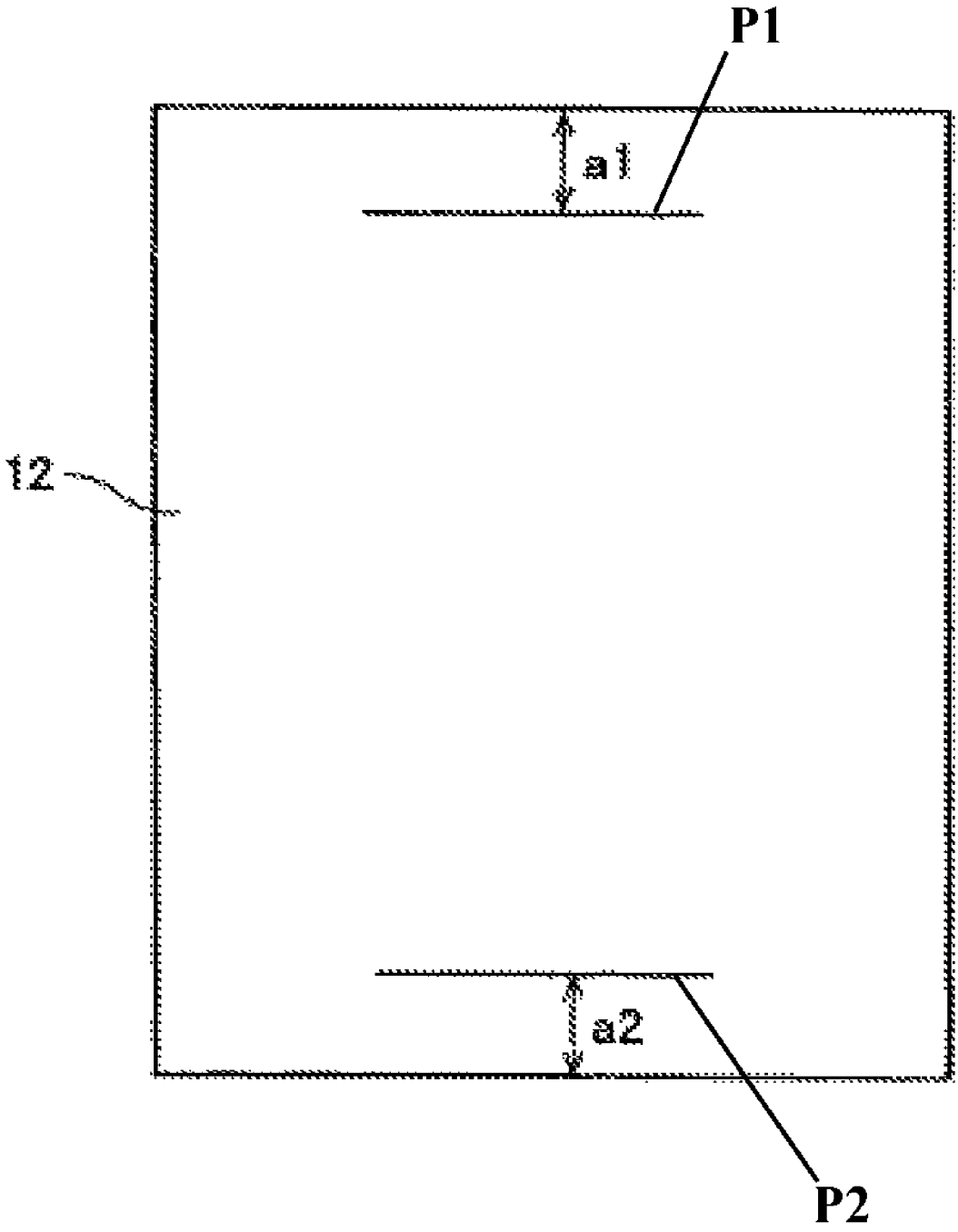
FIG. 22 is a drawing used to describe the exemplary registration adjustment process shown in FIG. 19.
Figure 23:
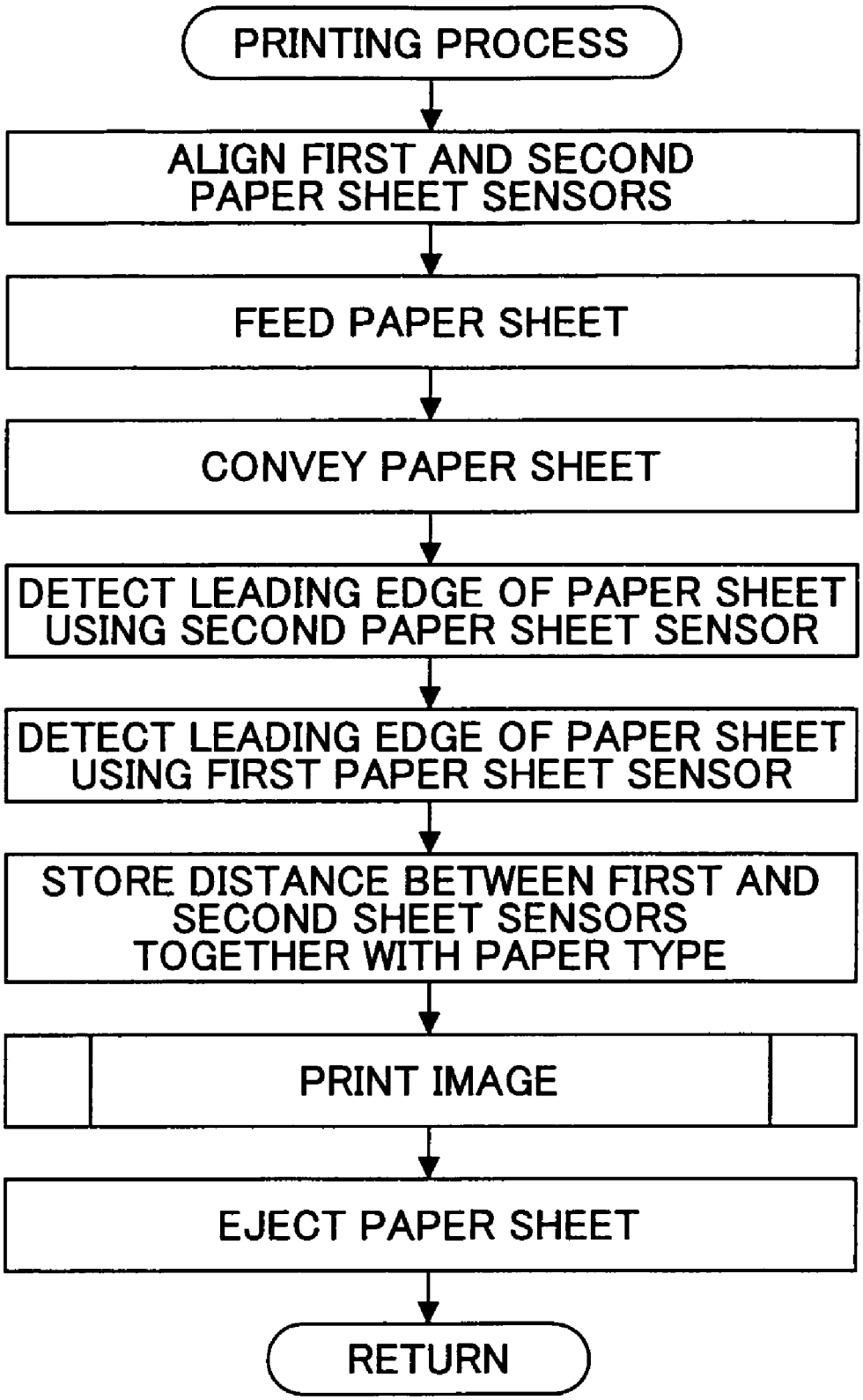
FIG. 23 is a flowchart showing an exemplary printing process where the distance between a first paper sheet sensor and a second paper sheet sensor is recorded.

For example, as shown in FIG. 22, the control unit 100 conveys the paper sheet 12 a distance (N1*a* (a theoretical value of the distance N1)+a1) after detecting the paper sheet 12 with the first paper sheet sensor 81, prints a pattern P1, further conveys the paper sheet 12 so that a position a distance a2 from the bottom edge of the paper sheet 12 comes right under the first nozzle **7*n*1 which distance a2 is equal to the distance a1, and prints a pattern P2. Theoretically, the patterns P1 and P2 completely overlap when the paper sheet 12** is folded into two.

However, the first paper sheet sensor 81 may not always be accurately positioned because of irregularities in assembling and therefore the distance a1 and the distance a2 may not become the same. When the first paper sheet sensor 81 is out of alignment in a direction opposite to the paper conveying direction, the distance a1 becomes smaller. When the first paper sheet sensor 81 is out of alignment in the paper conveying direction, the distance a1 becomes larger. The user checks the amount of misalignment and enters adjustment values (plus or minus) from, for example, the operations panel 117. As described above, the control unit 100 corrects the distance N1 between the first paper sheet sensor 81 and the first nozzle 7*n*1 based on the entered adjustment values, and corrects the distance N2 between the second paper sheet sensor 82 and the first nozzle 7*n*1 based on the corrected distance N1 and the distance X between the first paper sheet sensor 81 and the second paper sheet sensor 82.

As described above, recording the distance (distance X described above) between a first detecting unit and a second detecting unit makes it possible to correct the distance between the first detecting unit and a nozzle of a recording head and to correct the distance between the second detecting unit and the nozzle of the recording head based on the corrected distance. Such a mechanism makes it possible to perform registration alignment of detecting units without having to adjust detecting units one by one, thereby reducing the workload of performing registration alignment.

In an image forming apparatus where a paper sheet is conveyed around a conveying roller of a conveying unit, the distance between the rotation center of the conveying roller and the surface of the paper sheet varies depending on the thickness of the paper sheet. Therefore, the ratio of conveyed distance of the paper sheet to the amount of rotation of the conveying roller changes slightly depending on the thickness of the paper sheet.

The exemplary image forming apparatus may be configured to include multiple storage units (for example, allocated addresses in the non-volatile memory 104) to store multiple instances of the distance between the first detecting unit and the second detecting unit. Such a configuration makes it possible to store distance data for each paper type such as plain paper or thick paper and to perform registration adjustment for each paper type, thereby making it possible to accurately perform registration adjustment. For example, when forming an image, the exemplary image forming apparatus performs registration adjustment based on a correction value (registration value) corresponding to the paper type, for example, entered from the operations panel 117 or specified by the printer driver 91 of the host 90.

Also, an image forming apparatus may be configured to determine the distance between the first paper sheet sensor 81 and the second paper sheet sensor 82 during a normal printing process (image forming process) and to store the determined distance together with the type of the paper sheet 12 in a storage unit (for example, in a specified area in the non-volatile memory 104). Such a configuration makes it possible to skip registration adjustment steps such as determining the paper type and calculating the distance between the first paper sheet sensor 81 and the second paper sheet sensor 82, and to immediately print a registration adjustment pattern, thereby reducing the workload of performing registration alignment.

According to an embodiment of the present invention, an image forming apparatus includes a first detecting unit mounted on a carriage and configured to detect a recording medium; a second detecting unit placed upstream from the first detecting unit in the direction that the recording medium is conveyed and configured to detect the recording medium; and a control unit configured to control operations of the image forming apparatus. Such a configuration makes it possible to accurately detect the leading edge of the recording medium even when the distance between paper sheets is small by using either one of the first and second detecting units, thereby improving the printing speed.

An image forming apparatus according to an embodiment of the present invention also makes it possible to simplify the process of aligning the first and second detecting units and a nozzle of a recording head.

The present invention is not limited to the specifically disclosed embodiments, and variations and modifications may be made without departing from the scope of the present invention.

The present application is based on Japanese Priority Application No. 2005-305464 filed on Oct. 20, 2005, and Japanese Priority Application No. 2005-312213 filed on Oct. 27, 2005, the entire contents of which are hereby incorporated herein by reference.

The invention claimed is:

1. An image forming apparatus that forms an image on a recording medium by conveying the recording medium in a direction orthogonal to a scanning direction of a carriage having a recording head, comprising:

a first detecting unit mounted on the carriage and configured to detect a leading edge of the recording medium;

a second detecting unit placed upstream from the first detecting unit in the direction that the recording medium is conveyed, and configured to detect the recording medium; and a control unit configured to control operations of the image forming apparatus based on a detection result from the first detecting unit or the second detecting unit, wherein the control unit determines based on the detection result from the second detecting unit a timing at which the recording medium is to reach a detection position where the first detecting unit detects the leading edge of the recording medium, and when the recording medium is to reach the detection position before the first detecting unit reaches the detection position, uses the detection result from the second detecting unit to perform an image forming process.

2. The image forming apparatus as claimed in claim 1, wherein the control unit selects either the first detecting unit or the second detecting unit to detect the leading edge of the recording medium depending on a speed at which the recording medium is conveyed.

3. The image forming apparatus as claimed in claim 1, wherein the control unit selects either the first detecting unit or the second detecting unit to detect the leading edge of the recording medium depending on a print property.

4. The image forming apparatus as claimed in claim 1, wherein the control unit determines based on the detection result from the second detecting unit a timing at which the recording medium is to reach a detection position where the first detecting unit detects the leading edge of the recording medium, and when the recording medium is to reach the detection position before the first detecting unit reaches the detection position, reduces a speed at which the recording medium is conveyed.

5. The image forming apparatus as claimed in claim 1, wherein the first detecting unit and the second detecting unit detect the leading edge of the recording medium at different positions in the scanning direction of the carriage.

6. The image forming apparatus as claimed in claim 5, wherein the control unit determines an amount of skew of the recording medium based on detection results from the first detecting unit and the second detecting unit.

7. The image forming apparatus as claimed in claim 6, wherein the control unit rotates the image to be formed on the recording medium based on the determined amount of skew of the recording medium.

8. The image forming apparatus as claimed in claim 6, wherein the control unit, when the determined amount of skew of the recording medium is larger than a specified value, ejects the recording medium and feeds another recording medium into the image forming apparatus.

9. The image forming apparatus as claimed in claim 6, wherein the control unit, when the determined amount of skew of the recording medium is larger than a specified value, outputs an error message.

10. The image forming apparatus as claimed in claim 1, wherein the second detecting unit is positioned so as to face a conveying roller used to convey the recording medium toward an image forming area where the recording head forms the image.

11. The image forming apparatus as claimed in claim 10, wherein the conveying roller drives a conveyor belt configured to electrostatically attract the recording medium and thereby to convey the recording medium.

12. An image forming apparatus that forms an image on a recording medium by conveying the recording medium in a direction orthogonal to a scanning direction of a carriage having a recording head, comprising:

a first detecting unit mounted on the carriage and configured to detect a leading edge of the recording medium;

a second detecting unit placed upstream from the first detecting unit in the direction that the recording medium is conveyed, and configured to detect the recording medium; and a control unit configured to control operations of the image forming apparatus based on a detection result from the first detecting unit or the second detecting unit, wherein the control unit determines and records a distance between the first detecting unit and the second detecting unit.

13. The image forming apparatus as claimed in claim 12, wherein the control unit first aligns one of the first detecting unit and the second detecting unit and a nozzle of the recording head; and then aligns the other one of the first detecting unit and the second detecting unit and the nozzle of the recording head based on a result of the first alignment and the recorded distance.

14. The image forming apparatus as claimed in claim 12, wherein the control unit first aligns the first detecting unit and a nozzle of the recording head; and then aligns the second detecting unit and the nozzle of the recording head based on a result of the first alignment and the recorded distance.

15. The image forming apparatus as claimed in claim 12, wherein the control unit determines and records the distance between the first detecting unit and the second detecting unit while forming the image on the recording medium.

16. The image forming apparatus as claimed in claim 12, wherein the control unit determines and records the distance between the first detecting unit and the second detecting unit when the first detecting unit and the second detecting unit are aligned perpendicular to the scanning direction of the carriage.

17. The image forming apparatus as claimed in claim 12, wherein the control unit records multiple instances of the distance between the first detecting unit and the second detecting unit.

18. The image forming apparatus as claimed in claim 17, wherein each of the multiple instances of the distance between the first detecting unit and the second detecting unit corresponds to a type of the recording medium.

* * * * *